US007797979B2

(12) United States Patent
Beining et al.

(10) Patent No.: US 7,797,979 B2
(45) Date of Patent: Sep. 21, 2010

(54) CRIMPING APPARATUS INCLUDING A TOOL FOR SUPPORTING A PLURALITY OF CRIMPING MEMBERS

(75) Inventors: Michael Paul Beining, Holland, OH (US); Michael Scott Henning, Sandusky, OH (US); Joseph Thomas Mollitor, Concord, MI (US)

(73) Assignee: Eaton Corporation, Cleveland, OH (US)

( * ) Notice: Subject to any disclaimer, the term of this patent is extended or adjusted under 35 U.S.C. 154(b) by 462 days.

(21) Appl. No.: 11/751,258

(22) Filed: May 21, 2007

(65) Prior Publication Data

US 2007/0218748 A1 Sep. 20, 2007

Related U.S. Application Data

(63) Continuation-in-part of application No. 11/353,731, filed on Feb. 14, 2006, now abandoned.

(60) Provisional application No. 60/846,613, filed on Sep. 22, 2006.

(51) Int. Cl.
*B21D 41/00* (2006.01)
*B21J 7/16* (2006.01)
*B21J 13/03* (2006.01)

(52) U.S. Cl. ..... 72/402; 72/479; 72/481.1; 72/482.92

(58) Field of Classification Search ..... 72/402, 72/416, 479, 480, 481.1, 482.92
See application file for complete search history.

(56) References Cited

U.S. PATENT DOCUMENTS 1,322,584 A 11/1919 Kraft
1,818,435 A 8/1931 Smith et al.
1,890,016 A 12/1932 Smith et al.

(Continued)

FOREIGN PATENT DOCUMENTS

DE 198 42 765 A1 3/2000

(Continued)

OTHER PUBLICATIONS

International Search Report for WO2008035196.*

(Continued)

*Primary Examiner*—Dana Ross
*Assistant Examiner*—Mohammad Yusuf
(74) *Attorney, Agent, or Firm*—Pearne & Gordon LLP

(57) ABSTRACT

A crimping apparatus includes a support structure with an alignment element and a plurality of retainers movably attached to the support structure and radially arranged about an axis of the crimping apparatus. Each retainer includes an engagement structure. The crimping apparatus further includes a plurality of crimping members with an engagement element. Each engagement element is configured to interact with the engagement structure of a respective one of the plurality of retainers to removably connect each of the crimping members to a respective one of the plurality of retainers. The crimping apparatus further includes a tool configured to simultaneously support the plurality of crimping members. The tool includes an alignment structure configured to interact with the alignment element of the support structure to provide substantial radial alignment between the engagement element of each of the crimping members and the corresponding engagement structure of the respective retainers. The tool can also include a locking member configured to selectively lock the position of the tool with respect to the support structure.

14 Claims, 26 Drawing Sheets

U.S. PATENT DOCUMENTS

| | | | | | |
|---|---|---|---|---|---|
| 2,182,663 | A | | 12/1939 | Eby et al. | |
| 2,703,925 | A | | 3/1955 | Peck | |
| 2,746,327 | A | | 5/1956 | Runde | |
| 3,568,495 | A | | 3/1971 | Duffield et al. | |
| 3,731,518 | A | | 5/1973 | Blocher | |
| 3,851,514 | A | | 12/1974 | Chen et al. | |
| 4,034,592 | A | | 7/1977 | Chen et al. | |
| 4,250,607 | A | | 2/1981 | Lillbacka et al. | |
| 4,306,442 | A | | 12/1981 | Schröck | |
| 4,345,453 | A | * | 8/1982 | Lillbacka | 72/402 |
| 4,472,959 | A | | 9/1984 | Fencl | |
| 4,527,414 | A | | 7/1985 | Jurkovic et al. | |
| 4,641,516 | A | | 2/1987 | Satoh | |
| 4,766,808 | A | | 8/1988 | Schröck | |
| 4,774,828 | A | | 10/1988 | Schröck | |
| 4,989,443 | A | | 2/1991 | Sawdon | |
| 5,092,152 | A | | 3/1992 | Miller et al. | |
| 5,228,326 | A | | 7/1993 | Wasilko et al. | |
| 5,243,846 | A | * | 9/1993 | Davis et al. | 72/402 |
| 5,307,664 | A | | 5/1994 | Homm | |
| 5,353,623 | A | | 10/1994 | Bobenhausen | |
| 5,644,945 | A | | 7/1997 | Baldwin et al. | |
| 5,649,445 | A | | 7/1997 | Lavoie et al. | |
| 6,257,042 | B1 | * | 7/2001 | Valimaki et al. | 72/402 |
| 6,484,552 | B1 | | 11/2002 | Bernas et al. | |

FOREIGN PATENT DOCUMENTS

| | | | | |
|---|---|---|---|---|
| DE | 200 17 791 | U1 | | 2/2001 |
| DE | 199 58 103 | C1 | | 3/2001 |
| JP | 57109536 | A | | 7/1982 |
| WO | WO 02/47840 | A2 | | 6/2002 |
| WO | WO2004087349 | | * | 10/2004 |

OTHER PUBLICATIONS

Aeroquip Procrimp™ 1390 Crimp Machine, Operators Manual, 1996, 16 pages.

Aeroquip FT1390 Die Cage Operator's Manual, Sep. 2000, 7 pages.

Aeroquip Procrimp® 1370 Crimp Machine, Operator's Manual, Mar. 2001, 10 pages.

Crimp Your Gates Couplings with Confidence on your UNIFLEX Crimper, Gates® Catalog, Nov. 2003, 2 pages.

Portable T-480-HP Crimping Procedure, Eaton Weatherhead Hose Assembly Master Catalog W-HYOV-MC002-E, Nov. 2003, pp. 338-342.

Finn-Power® Swaging & Crimping, Finn Power Quick Change Tools, 2 pages, 2004.

Eaton Aeroquip, Fluid Conveyance Products, Master Catalog, Jan. 2005, Cover page, inside cover, and pp. 327-331.

Special Machines—HM 490, Uniflex, 3 pages (printed Jan. 9, 2006).

Special Machines—HM 500, HM 502, Uniflex, 3 pages (printed Jan. 9, 2006).

Customcrimp® Standard and Special Series Dies, catalog, 2 pages (Jan. 9, 2006).

U.S. Appl. No. 11/353,383, filed Feb. 14, 2006.

* cited by examiner

CRIMPING APPARATUS INCLUDING A TOOL FOR SUPPORTING A PLURALITY OF CRIMPING MEMBERS

CROSS-REFERENCE TO RELATED APPLICATIONS

This application is a continuation-in-part application of U.S. application Ser. No. 11/353,731, filed Feb. 14, 2006 and claims the benefit of U.S. Provisional Application No. 60/846,613, filed Sep. 22, 2006, the entire disclosures of which are hereby incorporated herein by reference.

FIELD OF THE INVENTION

The present invention relates to crimping apparatus, and more particularly to crimping apparatus including a tool for supporting a plurality of crimping members.

BACKGROUND OF THE INVENTION

Conventional die cage assemblies are known to be used with a crimping machine to crimp a fitting on an end of a hose. For example, a die cage assembly may be used with a Pro-Crimp™ 1390 crimping machine available from Eaton Aeroquip Inc. of Maumee, Ohio. Such a crimping machine may be used with various die cage assemblies, such as the die cage assembly disclosed by U.S. Pat. No. 6,484,552 which is incorporated by reference herein in its entirety. Die cage assemblies can be convenient to properly align die segments with respect to the crimping machine. Moreover, die cage assemblies can also provide a unitary structure that simplifies carrying and installation of the die segments by an operator setting up the crimping machine. However, a separate die cage assembly must be purchased for each desired predetermined crimping arrangement. Providing alternative crimping arrangements can be expensive since a separate die cage assembly must be purchased for each contemplated crimping arrangement.

Other crimping machines are known to receive alternative sets of crimp die segments, as disclosed for example, by U.S. Pat. No. 6,257,042. However, such crimping machines do not contemplate use of a removable die cage assembly with a crimping machine.

BRIEF SUMMARY OF THE INVENTION

Accordingly, it is an aspect of the present invention to obviate problems and shortcomings of conventional crimping apparatus.

To achieve the foregoing and other aspects and in accordance with the present invention, a crimping apparatus is provided. The crimping apparatus includes a support structure with an alignment element and a plurality of retainers movably attached to the support structure and radially arranged about an axis of the crimping apparatus. Each retainer includes an engagement structure. The crimping apparatus further includes a plurality of crimping members with an engagement element. Each engagement element is configured to interact with the engagement structure of a respective one of the plurality of retainers to removably connect each of the crimping members to a respective one of the plurality of retainers. The crimping apparatus further includes a tool configured to simultaneously support the plurality of crimping members. The tool includes an alignment structure configured to interact with the alignment element of the support structure to provide substantial radial alignment between the engagement element of each of the crimping members and the corresponding engagement structure of the respective retainers.

To achieve further aspects and in accordance with the present invention, a tool for supporting a plurality of crimping members with respect to a support structure is provided. The tool includes a support member with a plurality of carrying pins extending from the support member. Each of the carrying pins is configured to support a corresponding one of a plurality of crimping members. The tool further includes a locking member rotatably mounted with respect to the support member. The locking member includes a locking surface configured to selectively engage a support structure to selectively lock the position of the support member with respect to a support structure.

To achieve still further aspects and in accordance with the present invention, a crimping apparatus is provided. The crimping apparatus includes a support structure with at least one protrusion and a plurality of retainers movably attached to the support structure. The retainers are radially arranged about an axis of the crimping apparatus and each retainer includes an engagement structure. The crimping apparatus further includes a plurality of crimping members including an axial bore and an engagement element. Each engagement element is configured to interact with the engagement structure of a respective one of the plurality of retainers to removably connect each of the crimping members to a respective one of the plurality of retainers. The crimping apparatus further includes a tool with a support member including a plurality of carrying pins. Each carrying pin is configured to be inserted into the axial bore of a respective one of the plurality of crimping members to allow the tool to simultaneously support the plurality of crimping members. The support member further includes at least one opening configured to interact with the protrusion of the support structure to provide substantial radial alignment between the engagement element of each of the crimping members and the corresponding engagement structure of the respective retainers. The crimping apparatus further includes a locking member configured to selectively engage the protrusion of the support structure to selectively inhibit relative axial movement between the tool and the support structure along the axis of the crimping apparatus.

To achieve yet further aspects and in accordance with the present invention, a crimping apparatus is provided with a support structure and a plurality of retainers movably attached to the support structure and radially arranged about an axis of the crimping apparatus. Each retainer includes an engagement structure. The crimping apparatus further includes a plurality of crimping members with an engagement element, wherein each engagement element is configured to interact with the engagement structure of a respective one of the plurality of retainers to removably connect each of the crimping members to a respective one of the plurality of retainers. The crimping apparatus also includes a tool configured to simultaneously support the plurality of crimping members. The tool includes a locking member with a locking surface configured to selectively engage the support structure to selectively lock the position of the tool with respect to the support structure.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
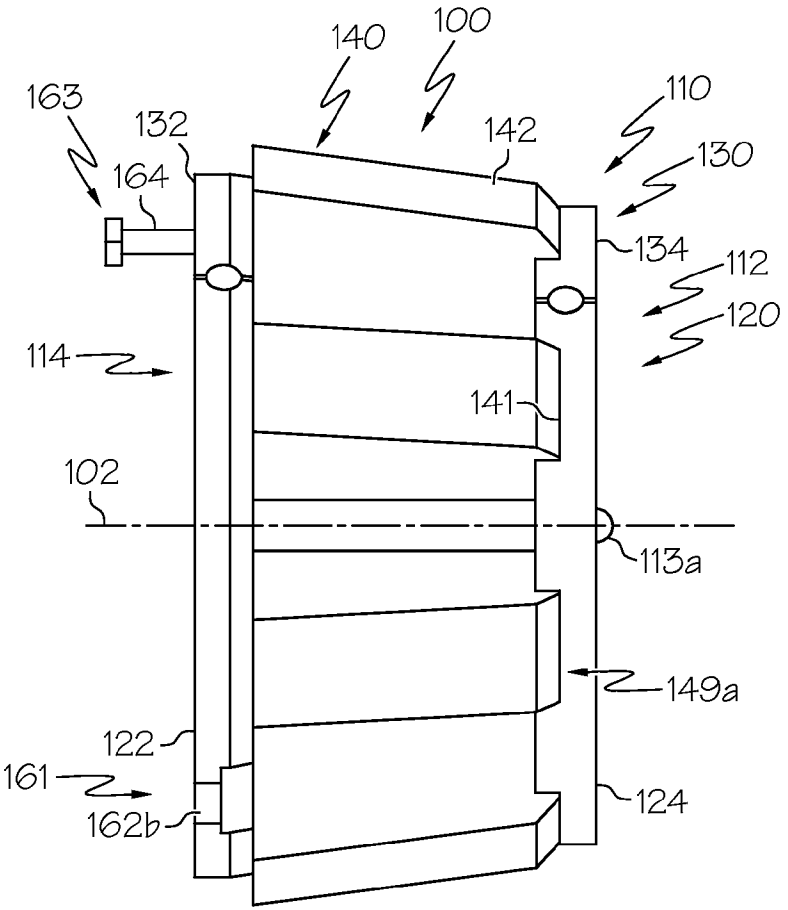
FIG. 1 is a side elevational view of one example of a crimping apparatus in accordance with aspects of the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Certain terminology is used herein for convenience only and is not to be taken as a limitation on the present invention. Further, in the drawings, the same reference numerals are employed for designating the same elements.

In accordance with aspects of the present invention, a crimping apparatus is provided for use with a crimping machine. One example of a crimping apparatus 100 incorporating aspects of the present invention is illustrated in FIGS. 1-4. The crimping apparatus 100 includes a support structure 110 and a plurality of die members 140 movably attached to the support structure 110.

Figure 3:
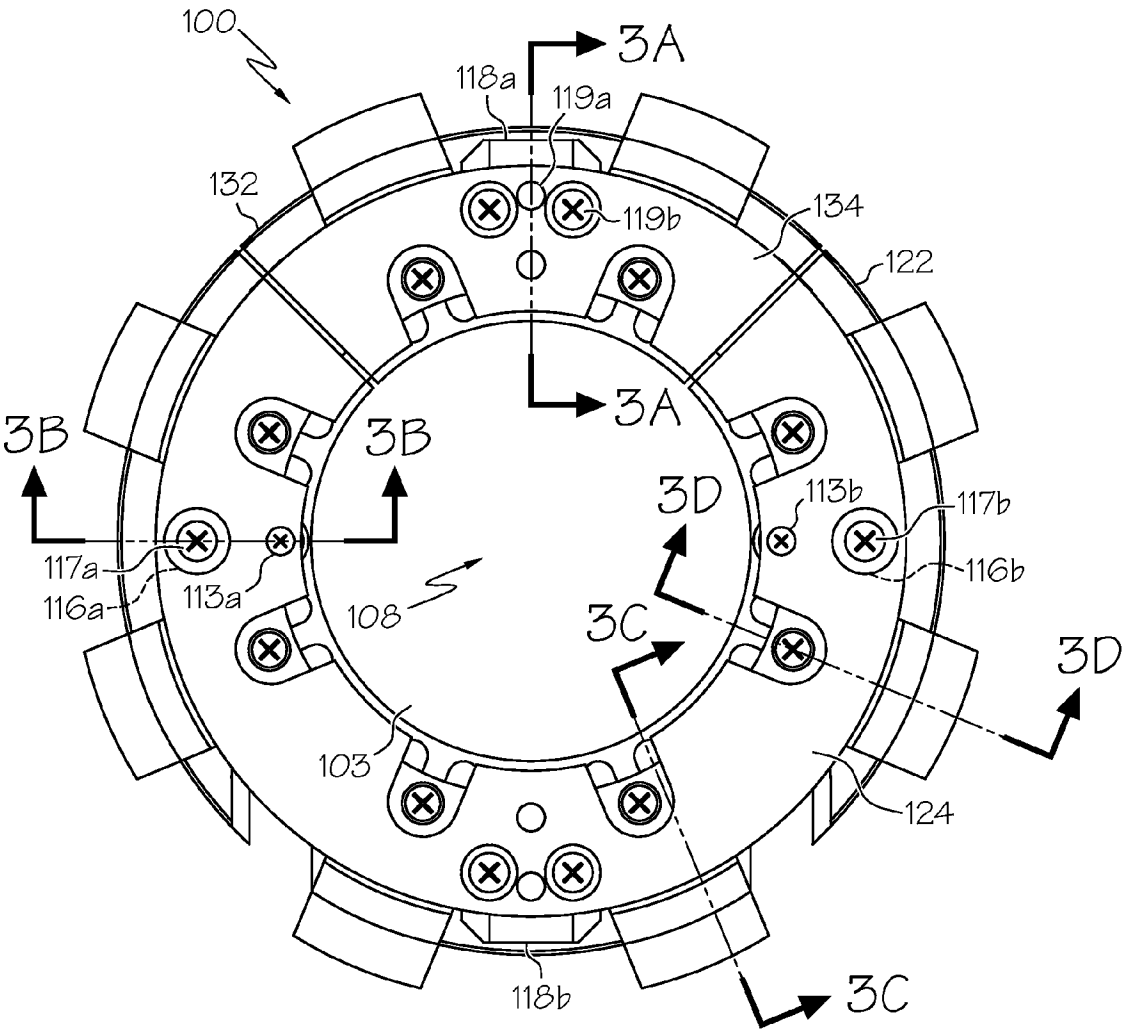
FIG. 3 is a front view of the crimping apparatus of FIG. 1.
Figure 3A:
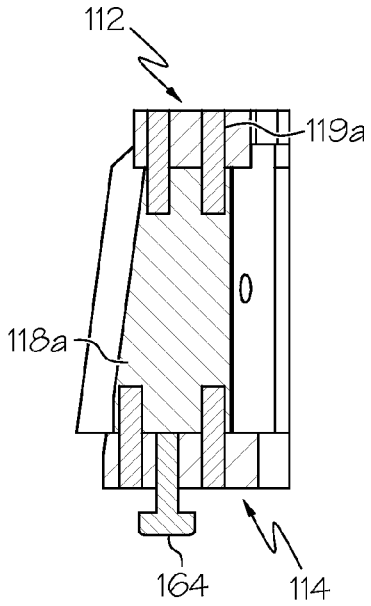
FIG. 3A is a sectional view of the crimping apparatus taken along line 3A-3A of FIG. 3.
Figure 3B:
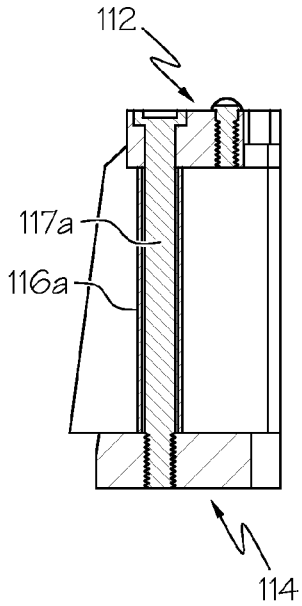
FIG. 3B is a sectional view of the crimping apparatus taken along line 3B-3B of FIG. 3.

Although not required, examples of support structures 110 can include a front member 112 and a rear member 114 that is attached, such as fixedly attached, to the front member 112. For instance, one or more spacers may be used to attach the rear member to the front member. Spacers can comprise a wide range of structures configured to provide attachment between the front and rear member. For example, as shown, the spacers can comprise one or more spacer blocks 118*a*, 118*b* and/or spacer tubes 116*a*, 116*b* positioned between at least portions of the front and rear member. In further examples, such spacers may be radially arranged about an axis 102 of the crimping apparatus in a wide variety of patterns. In one example, a pair of the spacers may be diametrically opposed to one another. As shown in FIGS. 1, 3 and 3B, the spacers can comprise a pair of diametrically opposed spacer tubes 116*a*, 116*b*. Features of the first spacer tube 116*a* are illustrated in the cross section of FIG. 3B wherein the second spacer tube 116*b* may include identical features. Each spacer tube 116*a*, 116*b* may be provided with a fastener that extends through the interior of the tube 116*a*, 116*b* to attach the front member 112 to the rear member 114. A wide variety of fasteners may be used such as a screw, nut and bolt combination, or the like. In the illustrative example shown in FIG. 3B, a screw 117*a* can be inserted through the spacer tube 116*a* to fasten the front member 112 to the rear member 114. Likewise, a similar screw 117*b* may be provided to extend through the spacer tube 116*b*.

In addition, or alternatively, the spacers can comprise one or more spacer blocks to enhance the structural integrity of the support structure. For example, as shown in FIGS. 3 and 3A, the spacers can comprise a pair of diametrically opposed spacer blocks 118*a*, 118*b*. Features of the first spacer block 118*a* are illustrated in the cross section of FIG. 3A wherein the second spacer block 118*b* may include identical features. Each end of the spacer block 118*a*, 118*b* can include one or more alignment pins 119*a* and one or more screws 119*b*. For example, one or more alignment pins 119*a* can be provided to help position the front member 112 and the rear member 114 with respect to each corresponding end of the spacer blocks. Moreover, one or more screws 119*b* may be provided to attach the front member 112 and the rear member 114 to each corresponding end of the spacer blocks.

Figure 4:
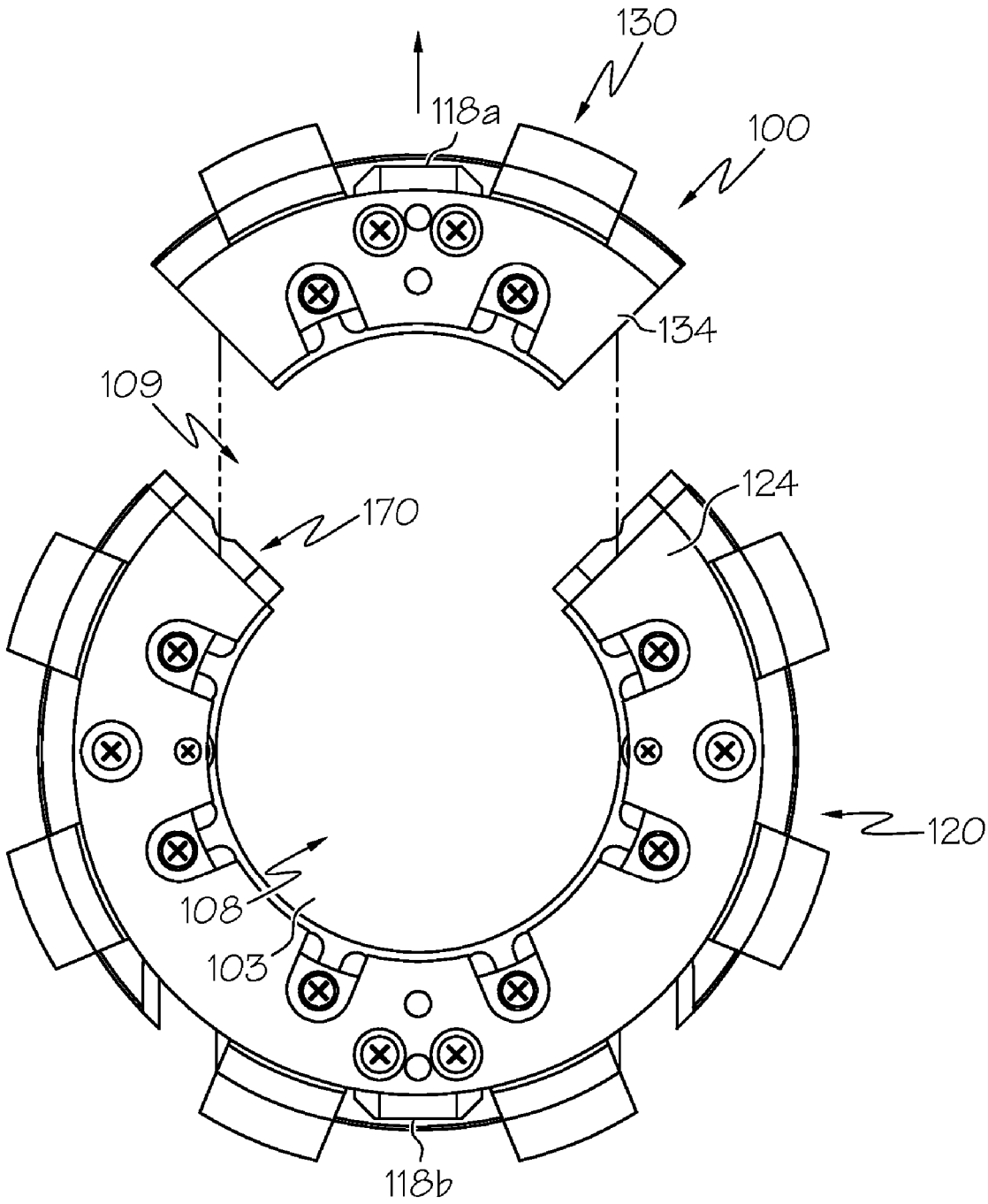
FIG. 4 is a front view of the crimping apparatus of FIG. 1 with a first portion and a second portion, wherein the second portion is moved completely out of engagement with the first portion.

Examples of crimping apparatus in accordance with the present invention may include a unitary support structure including a single portion. Alternatively, the support structure can include two or more portions that cooperate to provide the crimping apparatus. For instance, as shown, the support structure 110 can include a first portion 120 and a second portion 130. The second portion 130 can engage the first portion 120 to define an axial passage 108 into an interior area 103 of the crimping apparatus 100. As shown in FIG. 4, the second portion 130 can also be configured to be moved to define an alternative passage 109 into the interior area 103. For example, the second portion 130 can be pivotally connected to the first portion 120 to selectively define an alternative passage. In further examples, an alternative passage can be provided by providing a second portion 130 that can be moved completely out of engagement with the first portion 120. For example, as shown in FIG. 4, the second portion 130 can be designed to be moved completely out of engagement with the first portion 120 to selectively define the alternative passage 109 into the interior area 103 of the crimping apparatus 100. The alternative passage 109 can be designed to accommodate various elements that, due to the size and/or shape of the elements, might not otherwise be introduced into the interior area 103 by way of the axial passage 108. In the illustrated embodiment, the first and second portions 120, 130 are each designed to include at least one retainer 142 movably attached thereto. Although not shown, further examples one of the portions 120, 130 may be provided without any of the retainers. In further examples one of the portions 120, 130 may be provided with all of the retainers.

Figure 2:
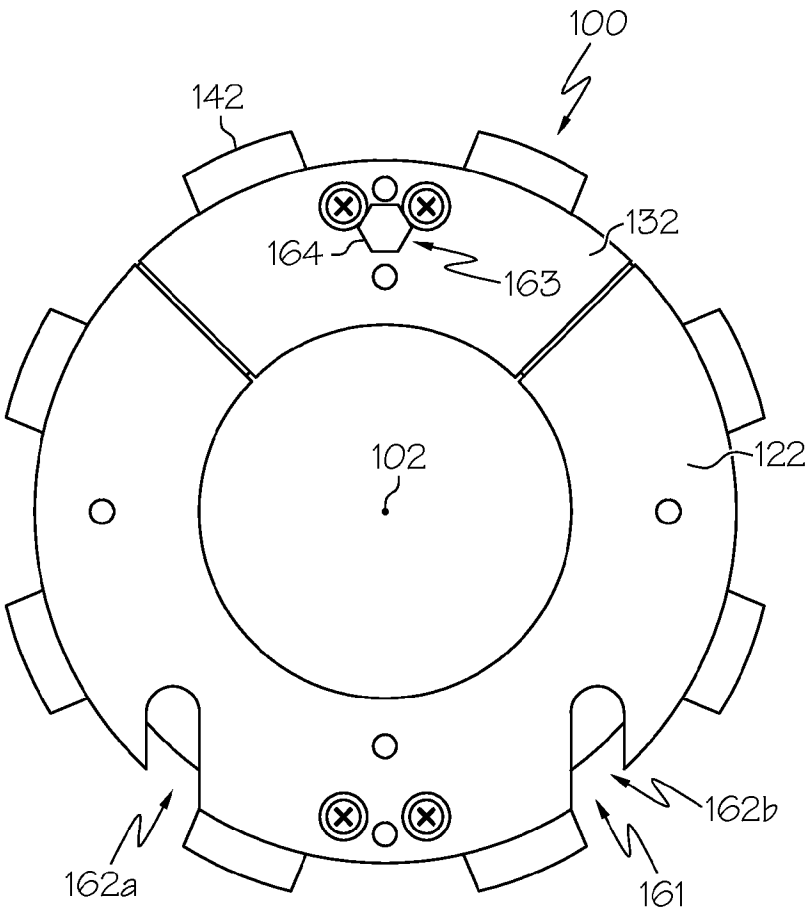
FIG. 2 is a rear view of the crimping apparatus of FIG. 1.
Figure 5:
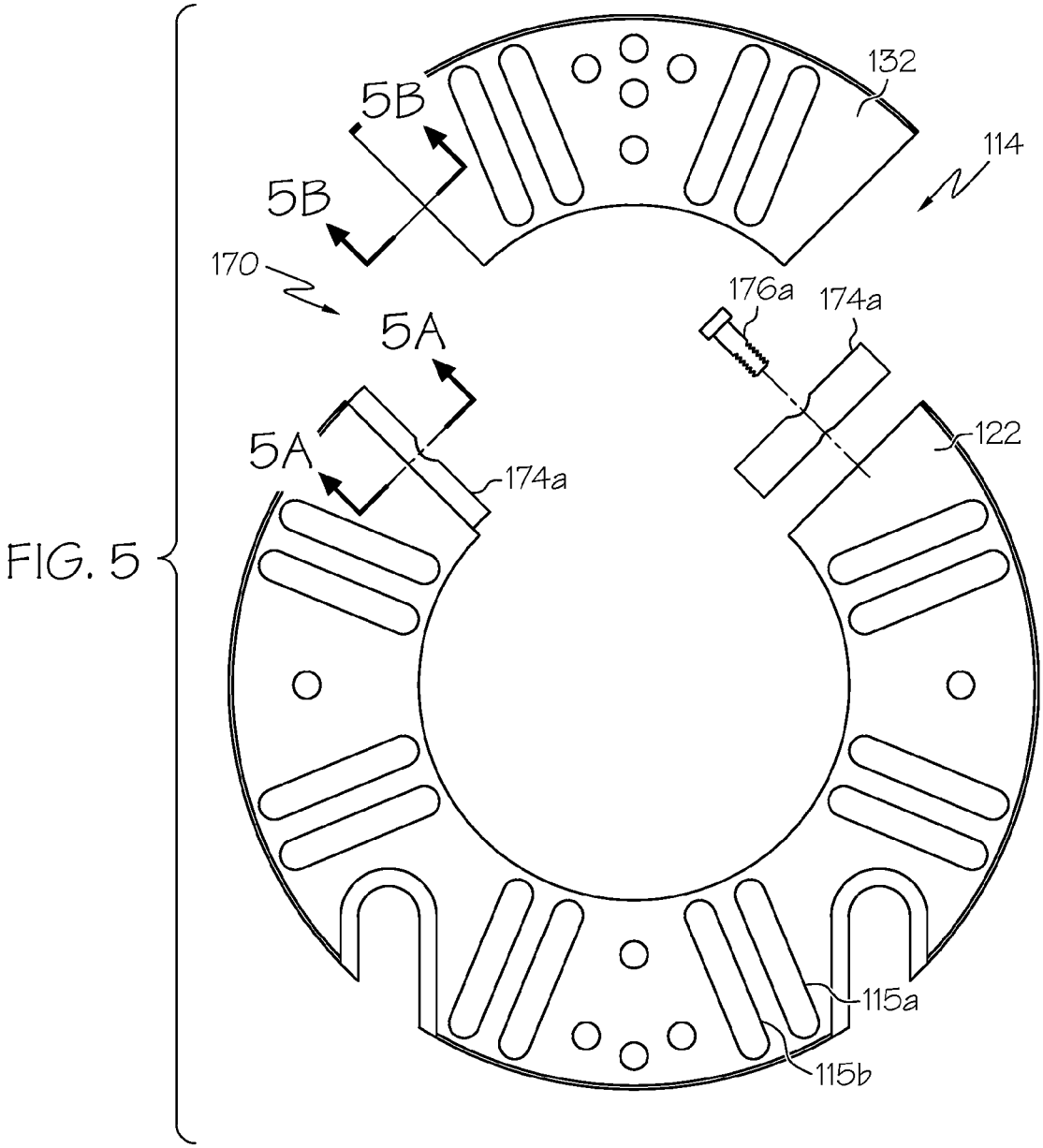
FIG. 5 is a front view of the rear member of the support structure.

Various structural arrangements may be provided to create the first and second portions 120, 130. For example, as shown in FIGS. 1, 3, 4, and 6, the front member 112 can be provided a first front member 124 and a second front member 134. As shown in FIGS. 1, 2, and 5, the rear member 114 can be provided with a first rear member 122 and a second rear member 132. The first portion 120 can be formed with the first rear member 122 attached, such as fixedly attached, to the first front member 124 while the second portion 130 can be formed with the second rear member 132 attached, such as fixedly attached, to the second front member 134.

In further examples, the crimping apparatus can also include an optional registration structure to facilitate a predetermined orientation between the first and second portions 120, 130 of the support structure 110. Various portions of the crimping apparatus 100 can comprise the registration structure. For example, the front member 112 and/or the rear member 114 of the support structure 110 can be provided with one or more registration structures. Various types of registration structures may also be used in accordance with aspects of the present invention. In one example, the registration structure can comprise an alignment tab mounted to one side of the front and/or rear member to provide registration between the first and second portions. In the illustrated example, the registration structure can comprise a tongue and groove structure 170 although other registration structures may be provided in further examples.

Many different structural arrangements may provide a tongue and groove structure. For example, the tongue and/or groove may be machined from portions of the crimping apparatus such that the tongue and/or groove are integral with the structure. In the illustrated example, opposed grooves 172*a*/173*a*, 172*b*/173*b* are machined into abutting locations of the first and second portions 120, 130. Another piece, e.g., a registration pin 174*a*, 174*b*, may be fastened to one of the grooves to define the tongue portion. For instance, as shown in FIG. 5, the rear member 114 comprises two tongue and groove structures 170 that are each defined by a registration pin 174*a* and two grooves 172*a*, 173*a* adapted to each simultaneously receive portions of the registration pin 174*a*.

Figure 5A:
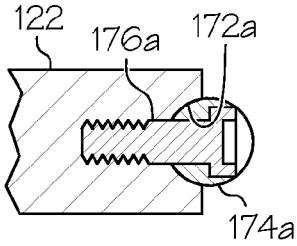
FIG. 5A is a sectional view of the rear member taken along line 5A-5A of FIG. 5.
Figure 5B:
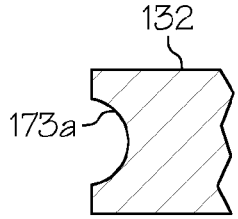
FIG. 5B is a sectional view of the rear member taken along line 5B-5B of FIG. 5.

Indeed, as shown in FIGS. 5, 5A, and 5B, each tongue and groove structure 170 comprises a groove 172*a* defined in the first rear member 122 and a groove 173*a* defined in the second rear member 132. A registration pin 174*a* can be mounted with respect to one of the grooves 172*a*, 173*a*. Mounting of the registration pin 174*a* may be provided by a fastener, adhesive, welding and/or other mounting structures. In the illustrated example, a screw 176*a* can be provided to extend through a counterbore in the registration pin 174*a* to mount the registration pin 174*a* with respect to the first rear member 122. Once mounted, a portion of a corresponding registration pin 174*a* longitudinally extends within the corresponding groove 172*a* defined in the first rear member 122. Another portion of each corresponding registration pin 174*a* extends out of the corresponding groove 172*a* to define the tongue portion of the tongue and groove structure 170. The tongue portion is configured to be received in a corresponding groove 173*a* defined in the second rear member 132. Therefore a predetermined orientation may be achieved between the first and second rear members 122, 132 by way of one or more tongue and groove structures 170 and/or other registration structures.

Figure 6:
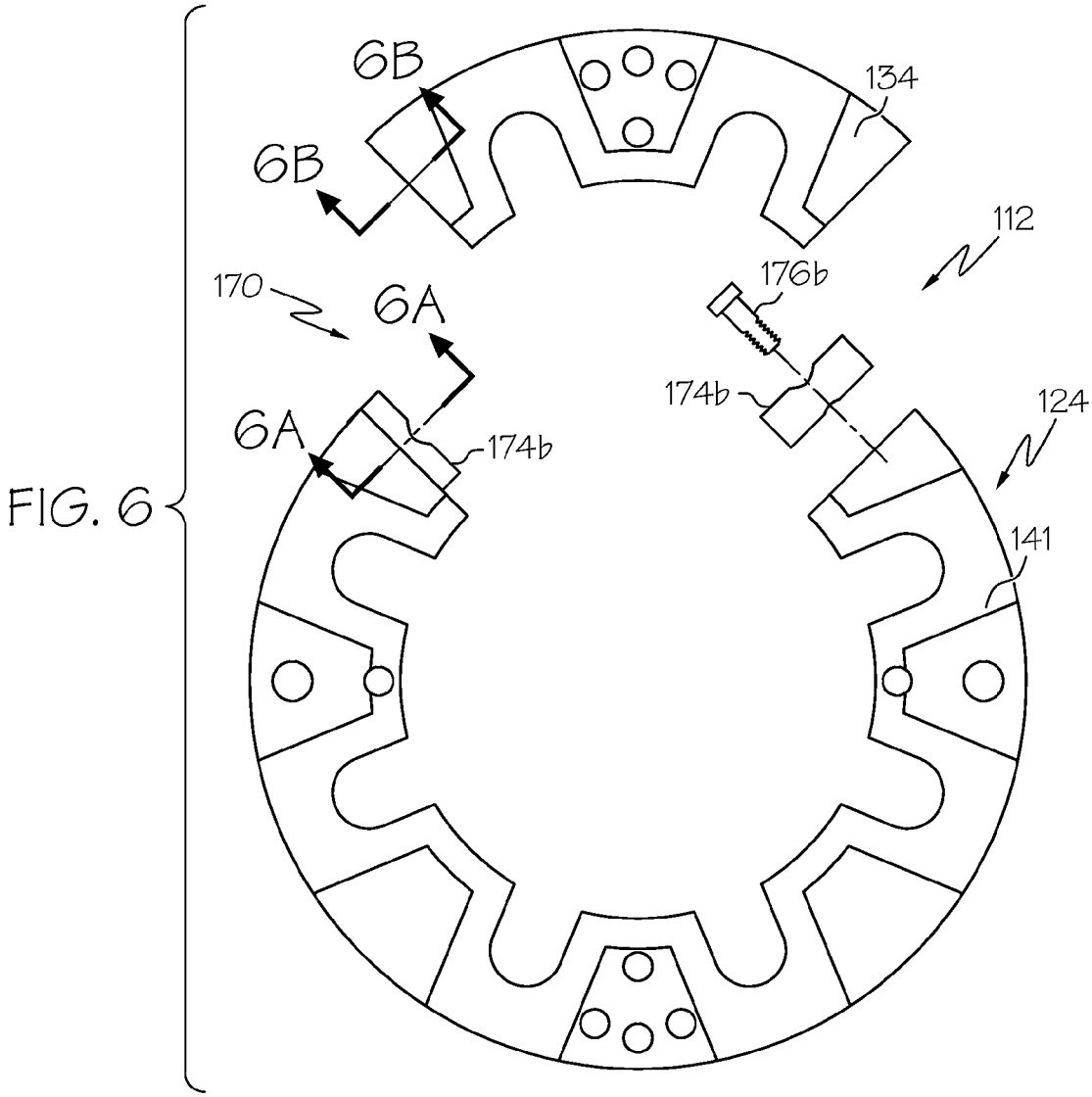
FIG. 6 is a rear view of the front member of the support structure.
Figure 6A:
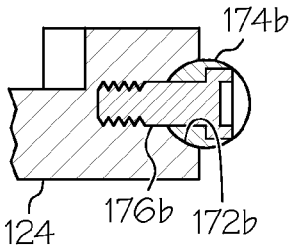
FIG. 6A is a sectional view of the front member taken along line 6A-6A of FIG. 6.
Figure 6B:
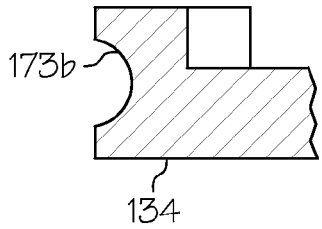
FIG. 6B is a sectional view of the front member taken along line 6B-6B of FIG. 6.

In addition, or alternatively, the front member 112 can be provided with one or more tongue and groove structures or other registration structures. As shown in FIG. 6, the illustrative example of the front member 112 comprises two tongue and groove structures 170 that are each defined by a registration pin 174*b* and two grooves 172*b*, 173*b* adapted to each simultaneously receive portions of the registration pin 174*b*. As shown in FIGS. 6, 6A and 6B, each tongue and groove structure 170 comprises a groove 172*b* defined in the first front member 124 and a groove 173*b* defined in the second front member 134. A registration pin 174*b* of each tongue and groove structure can be mounted with respect to one of the grooves 172*b*, 173*b*, for example, as described with respect to the registration pin 174*a* above. For instance, a screw 176*b* can be provided to extend through a counterbore in the registration pin 174*b* to mount the registration pin 174*b* with respect to the first front member 124. Once mounted, a portion of a corresponding registration pin 174*b* longitudinally extends within the corresponding groove 172*b* defined in the first front member 124. Another portion of each corresponding registration pin 174*b* extends out of the corresponding groove 172*b* to define the tongue portion of the tongue and groove structure 170. The tongue portion is configured to be received in a corresponding groove 173*b* defined in the second front member 134. Therefore, like the first and second rear members 122, 132, a predetermined orientation may be achieved between the first and second front members 124, 134 by way of one or more tongue and groove structures 170 and/or other registration structures. As shown, each tongue includes a cylinder of substantial semicircular cross section while the groove comprises a substantial semicircular groove configured to receive the tongue. In further examples, the tongue and groove may comprise other shapes such as rectangular, square, triangular or other cross sectional shapes.

The crimping apparatus 100 can be used with a wide range of crimping machines. For example, the crimping apparatus 100 can be used with a ProCrimp™ 1390 crimping machine available from Eaton Aeroquip Inc. of Maumee, Ohio. An Aeroquip ProCrimp™ 1390 crimping machine is illustrated somewhat schematically as reference number 500 in FIGS. 10-19. It is understood that other crimping machines may be used with one or more aspects of the present invention. Regardless of the crimping machine used, the crimping apparatus 100 can be configured to be removably positioned with respect to the crimping machine while the retainers 142 remain movably attached to the support structure 110. In further examples, the crimping apparatus may be incorporated, such as nonremovably incorporated, as part of the crimping machine for use with a tool in accordance with aspects of the present invention.

Figure 11:
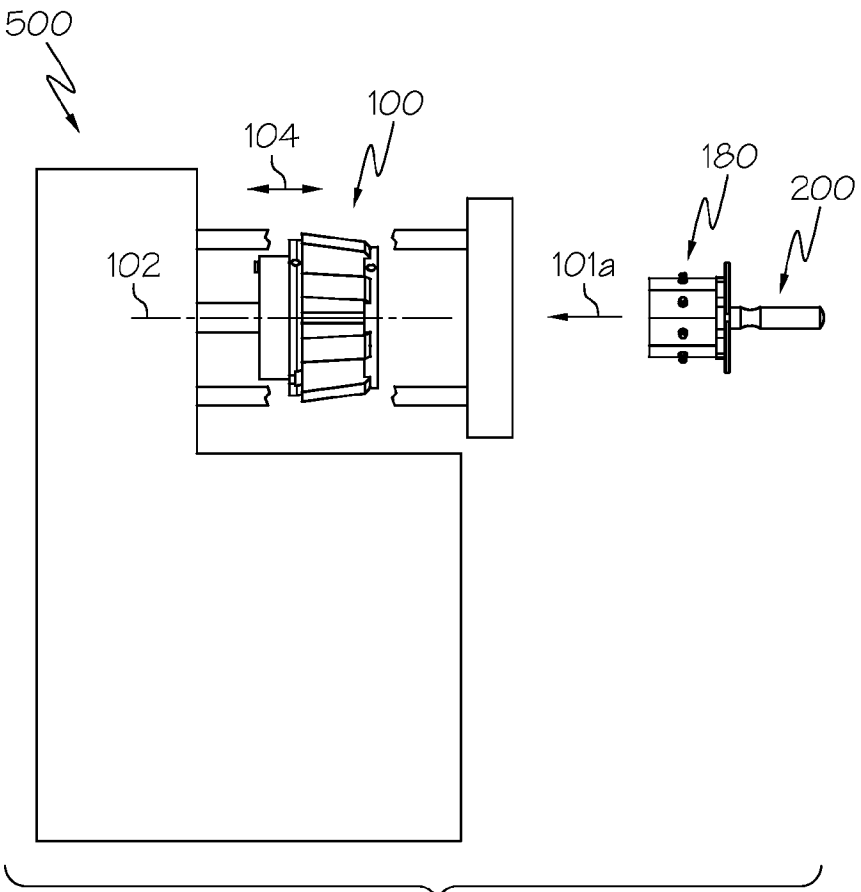
FIG. 11 depicts the crimping apparatus and crimping machine of FIG. 10 with the crimping apparatus being mounted to the crimping machine and the crimping member set and crimping tool of FIG. 7 being aligned with an axis of the crimping apparatus.
Figure 10:
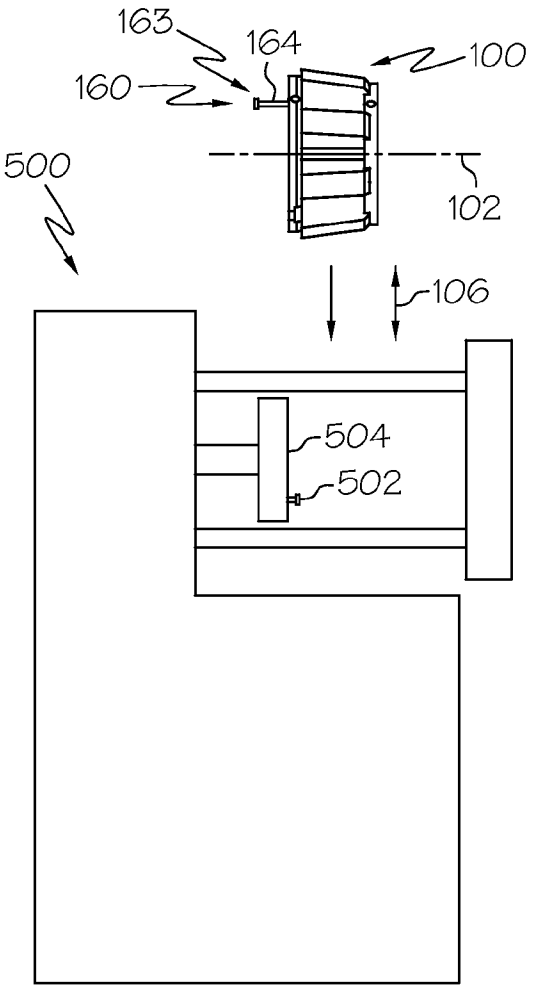
FIG. 10 depicts a schematic view of an example crimping machine and the example crimping apparatus of FIG. 1 prior to being mounted to the crimping machine.

As shown in the partial schematic views of FIGS. 10 and 11, the crimping apparatus 100 can include a connecting structure 160 configured to permit mounting of the crimping apparatus 100 to the crimping machine 500 to substantially inhibit a relative movement between the crimping apparatus 100 and a portion of the crimping machine 500 along a direction 104 that is substantially parallel to the axis 102 of the crimping apparatus 100. The connecting structure 160 can also be configured to permit dismounting of the crimping apparatus 100 from the crimping machine 500 by permitting a relative movement between the crimping apparatus 100 and the portion of the crimping machine 500 along a direction 106 that is substantially perpendicular to the axis 102 of the crimping apparatus 100. In addition, or alternatively, the connecting structure 160 may be configured to permit dismounting of the crimping apparatus 100 from the crimping machine 500 by permitting a relative movement between the crimping apparatus 100 and the portion of the crimping machine 500 along one or more other directions that are not substantially perpendicular to the axis of the crimping apparatus.

The connecting structure 160 can comprise a wide range of structures and can comprise a plurality of identical or different connecting members. In one example, a tool such as a wrench or screw driver can be used to tighten a connecting member to mount the crimping apparatus to the crimping machine. Once appropriately mounted with the tool, the connecting structure can substantially inhibit a relative movement between the crimping apparatus and a portion of the crimping machine along a direction that is substantially parallel to the axis of the crimping apparatus. Moreover, upon loosening and/or removal of the screws or bolts with the tool, the connecting structure can also be configured to permit dismounting of the crimping apparatus from the crimping machine by permitting a relative movement between the crimping apparatus and the portion of the crimping machine along a direction that is substantially perpendicular to the axis of the crimping apparatus.

In further examples, the connecting structure can be designed to permit tooless removable mounting between the crimping apparatus and the crimping machine. For example, tooless removable mounting can include mounting the crimping apparatus to the crimping machine without the use of tools. Tooless removable mounting can also include dismounting the crimping apparatus from the crimping machine without the use of tools. In further examples, tooless removable mounting can include mounting and dismounting between the crimping apparatus and the crimping machine without the use of tools. Providing a tooless connecting structure can be beneficial to permit mounting and/or dismounting between the crimping apparatus and the crimping machine with reduced time and effort. Various connecting structures may be provided to permit tooless removable mounting between the crimping apparatus and the crimping machine. For example, a latching or interlocking arrangement may be provided. In one example a tongue and groove structure may be provided. One example of the tongue and groove structure can comprise a dovetail structure although other tongue and groove structures may be provided.

As shown in FIGS. 10 and 11, the connecting structure 160 provides tooless removable mounting between the crimping apparatus 100 and the crimping machine 500. Referring to FIGS. 1 and 2, the connecting structure 160 can comprise a first connecting device 161 and/or a second connecting device 163. The first connecting device 161 can comprise a groove structure although the first connecting device may be provided, additionally or alternatively, with a tongue structure. As shown, the groove structure comprises a pair of slots 162*a*, 162*b* although one or more than two slots may be provided in further examples. The slots 162*a*, 162*b*, are configured to receive a corresponding shank of a screw 502 (see FIG. 10) attached to a press plate 504 of the crimping machine 500. The second connecting device 163 comprises a tongue of a tongue and groove structure although the second connecting device may be provided, additionally or alternatively, with a groove structure. In the illustrated example, the tongue comprises a screw 164 attached to the rear member 114 and configured to be received in a corresponding slot (not shown) of the press plate 504.

Figure 16:
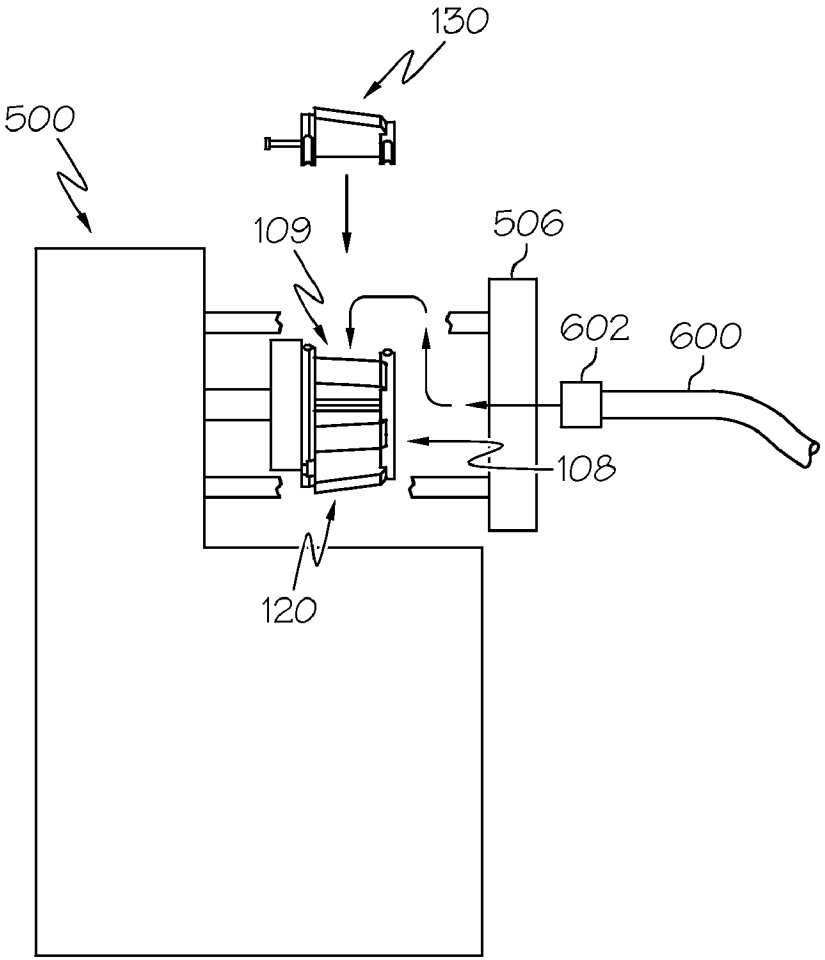
FIG. 16 depicts a second element and an end of a first element being inserted through an alternative passage into the interior area of the crimping apparatus, and thereafter moving the second portion to engage the first portion of the support structure.
Figure 15:
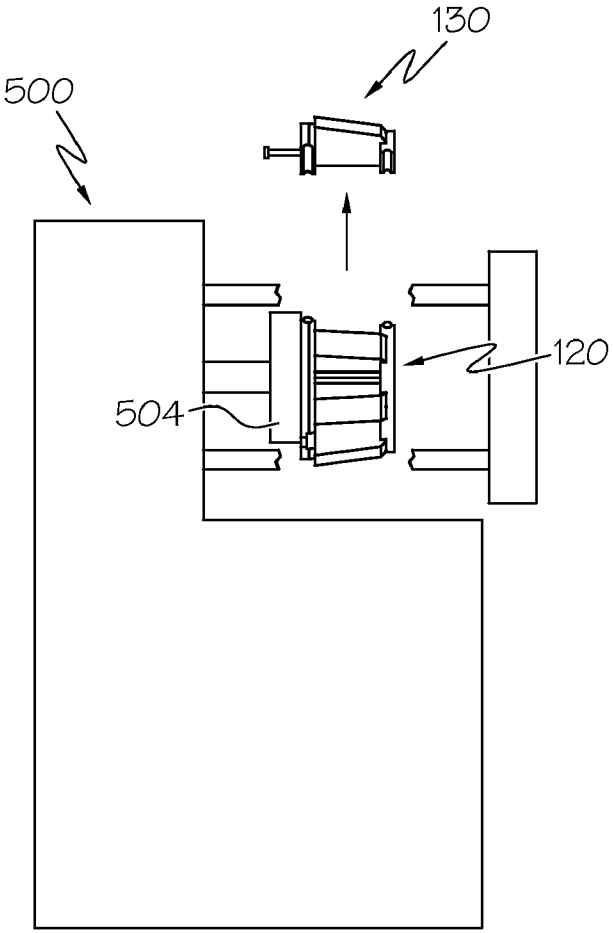
FIG. 15 depicts the crimping apparatus of FIG. 14B moved further away from the cam ring of the crimping machine and having a second portion of a support structure being moved completely out of engagement with a first portion of the support structure.

If the support structure 110 is provided with a first portion 120 and a second portion 130, as described above, it is also contemplated that each portion 120, 130 of the support structure 110 may be provided with at least one connecting member to facilitate axial alignment between the portions and concurrent movement between the press plate and the portions of the support structure. For example, as shown, the first portion 120 of the support structure 110 is provided with the first connecting member 161 while the second portion 130 of the support structure 110 is provided with the second connecting member 163. The connecting members 161, 163 are configured to mount the crimping apparatus 100 to the crimping machine 500 such that the first and second portions 120, 130 of the support structure 110 are axially aligned with respect to one another. Moreover, the connecting members 161, 163 permit concurrent movement between the press plate 504 and first and second portions 120, 130 of the support structure 110. Providing each portion 120, 130 of the support structure 110 with a connecting member also permits removal of one or more of the portions from the crimping machine while the remaining portions of the support structure remain connected to the crimping machine. For example, as shown in FIGS. 15 and 16, the first portion 120 remains connected to the press plate 504 while removing the second portion 130 from the first portion 120.

It is also contemplated that at least one portion of the support structure 110 may be provided without a connecting member configured to directly connect to the crimping machine while at least one other portion of the support structure includes a connecting member configured to directly connect to the crimping machine. For example, the first portion 120 may be provided with a connecting member to connect to the crimping machine while the second portion 130 does not include a connecting member to connect directly to the crimping machine. In such embodiments, the first and second portions 120, 130 may be configured to attach to one another such that the second portion 130 is indirectly attached to the crimping machine by way of the first portion 120. For example, the first portion 120 may include a connecting member to directly attach the first portion 120 to the crimping machine. A latching structure, fastening arrangement, or other attaching structure may be used to attach the second portion 130 to the first portion 120. The attachment between the first and second portions 120, 130 can facilitate axial alignment between the portions. Moreover, the connection between the first portion 120 and the press plate 504 and the connection between the first and second portions 120, 130 can facilitate concurrent movement between the press plate 504 and the portions of the support structure 110.

Figure 3C:
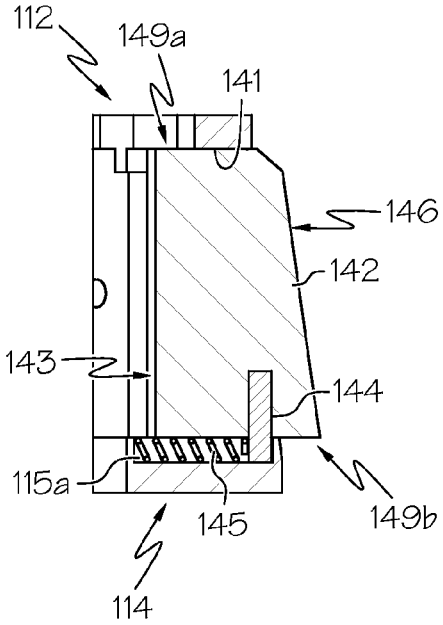
FIG. 3C is a sectional view of the crimping apparatus taken along line 3C-3C of FIG. 3.

The support structure 110 can comprise a wide variety of configurations to permit movable attachment of a plurality of retainers 142 to the support structure 110. For instance, the front member 112 and/or the rear member 114 can be configured to permit movable attachment of the retainers 142. As shown in FIGS. 1 and 6, the front member 112 can comprise a plurality of guide channels 141 radially arranged about the axis 102 of the crimping apparatus 100. As shown in FIGS. 1 and 3C, each of the guide channels 141 is adapted to slidingly receive a first end portion 149*a* of a corresponding retainer 142 to allow each retainer 142 to move with respect to the support structure 110 in a direction toward and away from the axis 102 of the crimping apparatus 100. As shown in FIGS. 3C and 5, the rear member 114 can comprise a pair of guide channels 115*a*, 115*b* associated with each retainer 142 that are configured to receive an end of a corresponding guide pin 144 to define the maximum and minimum movements of the retainers 142. Although a pair of guide channels 115*a*, 115*b* are illustrated, it is understood that a single or more than two guide channels may be associated with each retainer 142. Each of the guide channels 115*a*, 115*b* are configured to receive an end of a guide pin 144 extending from a second end portion 149*b* of a corresponding retainer 142 to limit movement of the retainers 142. As further illustrated in FIG. 3C, one or all of the guide channels 115*a*, 115*b* associated with each retainer 142 may include a biasing member, such as a compression spring 145. The compression spring 145 can be positioned in the guide channels to act against the guide pins 144 to bias each retainer 142 away from the axis 102, thereby maximizing the interior area 103 of the crimping apparatus 100. Each of the guide channels 115*a*, 115*b* may be provided with a similar compression spring 145 to increase the force exerted on the retainers 142. As shown in FIG. 3C, each retainer 142 further includes one side comprising a cam surface 146 that flares outwardly from the axis 102 in a direction from the first end portion 149*a* to the second end portion 149*b* of the retainer 142.

The die members 140 can include various structures and sizes for performing a crimping action with the crimping machine 500. For example, as shown, each die member 140 includes a retainer 142 configured to removably connect a separate crimping member 182 to the retainer 142. Thus, the crimping apparatus 100 including retainers 142 can be sold separately from the crimping members 182. The crimping apparatus 100 can therefore act as a master assembly that can receive different sets of crimping members to provide a wide variety of alternative crimping arrangements. Only one master assembly needs to be purchased and one or more less expensive crimping sets may be purchased to provide alternative crimping arrangements for effectively crimping elements having different sizes and/or shapes.

Figure 3D:
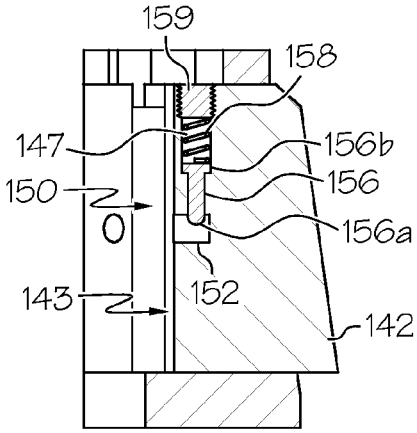
FIG. 3D is a sectional view of the crimping apparatus taken along line 3D-3D of FIG. 3.
Figure 8:
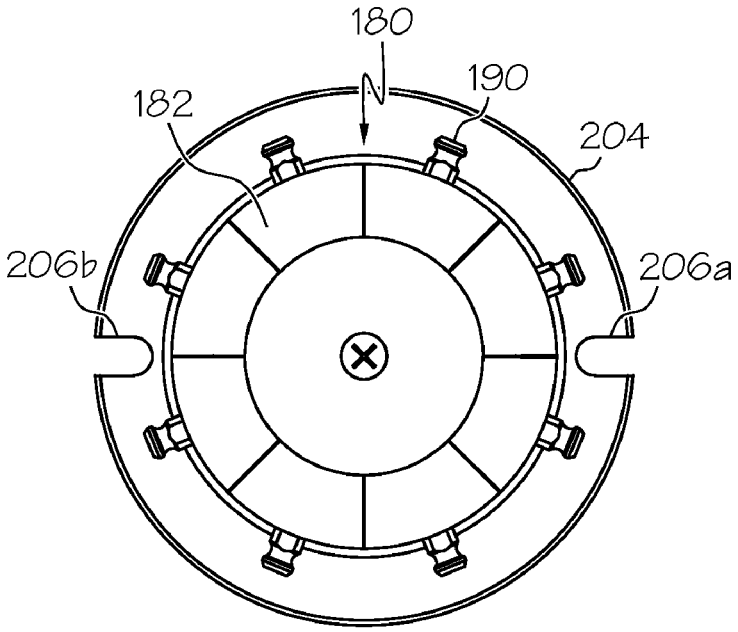
FIG. 8 is a rear view of the crimping member set and carrying tool of FIG. 7.
Figure 9:
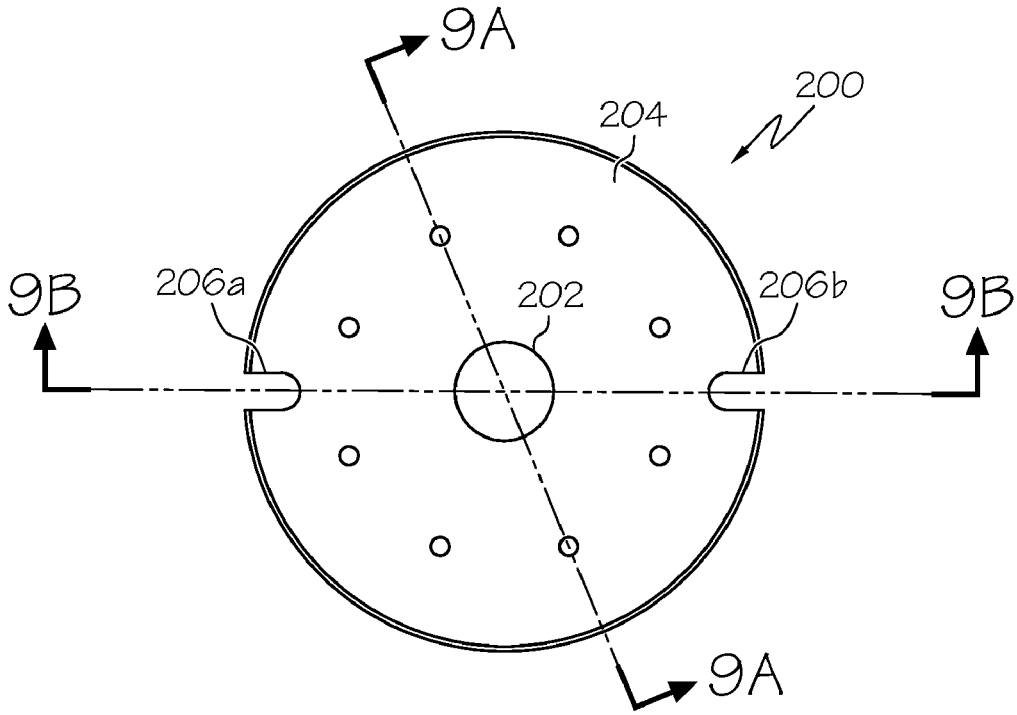
FIG. 9 is a front view of the crimping member set and carrying tool of FIG. 7.
Figure 12A:
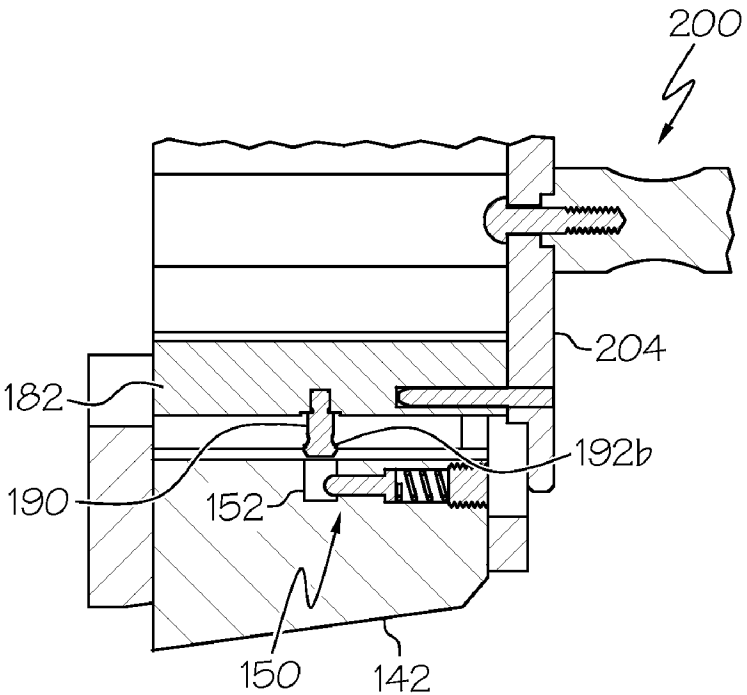
FIG. 12A depicts a partial sectional view of FIG. 12 illustrating a protrusion of a crimping member being aligned with an aperture of an engagement structure of a retainer.

Each retainer 142 can further comprise an engagement structure 150 configured to removably connect a crimping member 182 to the retainer 142. Various engagement structures may be used in accordance with aspects of the present invention. For example, a dovetail joint, tongue and groove structure, or other connecting structure may be used. In accordance with one example, the engagement structure can include an aperture and/or a latch. In one example, the engagement structure illustrated and described with respect to FIGS. 8-10 of U.S. Pat. No. 6,257,042, which is herein incorporated by reference, may be used in accordance with aspects of the present invention. As shown in FIGS. 3D and 12A, the engagement structure 150 can include an aperture 152 extending through a press surface 143 of the retainer 142. The aperture 152 is configured to selectively receive an engagement element, such as a protrusion 190, from a corresponding crimping member 182. As further shown, the engagement structure 150 can also include a latch configured to engage the protrusion 190 of the crimping member 182 to removably connect the crimping member 182 to the retainer 142. Although a wide variety of latches may be used, the illustrated latch comprises a pin 156 with a rounded end portion 156*a* that is biased to extend into the aperture 152. The pin 156 can include a shoulder 156*b* configured to act as a stop to limit the extent that the end portion 156*a* may move into the aperture 152. A biasing member, such as the illustrated compression spring 158, is configured to extend within a bore 147 in the retainer 142. An end cap 159 is threaded into an end of the bore 147 to retain the spring 158 and the pin 156 and to provide a precompression to the spring 158 to bias the end portion 156*a* into the aperture 152.

Figure 7:
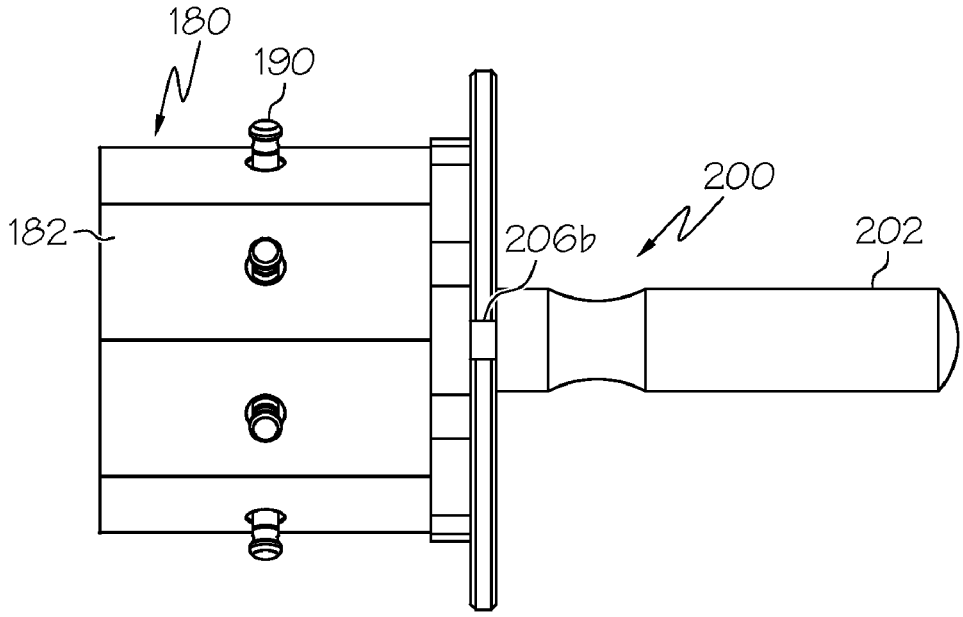
FIG. 7 is a side elevational view of one example of a crimping member set being carried by one example of a carrying tool in accordance with aspects of the present invention.

A plurality of crimping members may also be provided for attaching to the retainers. For example, an engagement element, such as a protrusion 190, from each crimping member 182 may be extended within the aperture 152 to be engaged by the latch for removably connecting the crimping member 182 to the corresponding retainer 142. Each crimping member 182 may be separately connected to each corresponding retainer 142. Alternatively, a plurality of crimping members 182 may be simultaneously connected to each corresponding retainer 142. For example, in accordance with one example, each crimping member 182 of a crimping member set 180 may be simultaneously attached to a corresponding one of each of the retainers 142. FIG. 7 illustrates a crimping member set 180 being supported by an optional tool 200.

The tool 200 may simultaneously support the crimping members 182 for simultaneous attachment to the corresponding retainers 142. As shown in FIGS. 7, 8, 9, 9A and 9B, the tool 200 can include a handle 202 attached to a first side 205*a* of an alignment member 204. The alignment member is illustrated as a circular plate although rectangular or other shape alignment members may be provided. Moreover, structures other than plate structures may be provided in further examples.

Figure 9A:
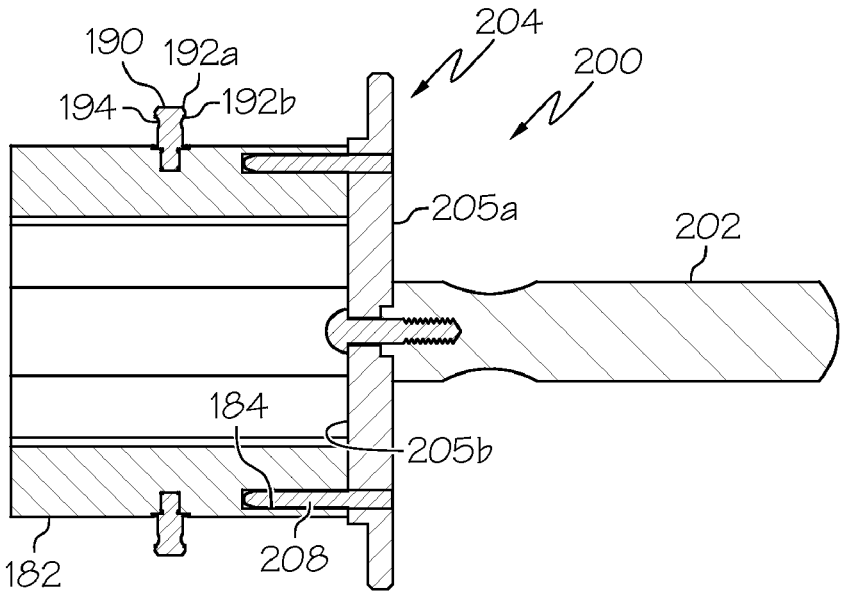
FIG. 9A is a sectional view of the crimping member set and carrying tool taken along line 9A-9A of FIG. 9.
Figure 9B:
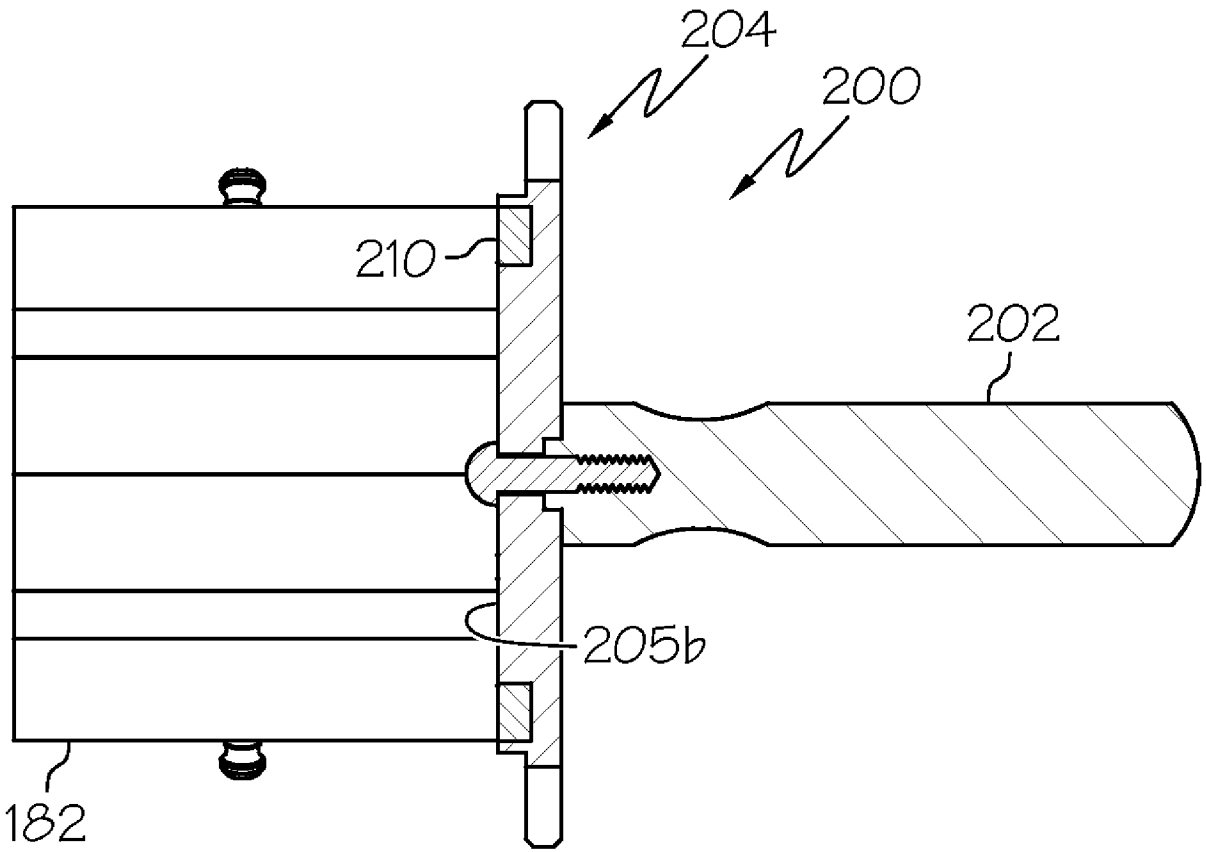
FIG. 9B is a sectional view of the crimping member set and carrying tool taken along line 9B-9B of FIG. 9.

A plurality of carrying pins 208 can be attached to the alignment member 204 to extend from the second side 205*b* of the alignment member 204. As shown in FIG. 9A, each carrying pin 208 is configured to be received in a corresponding carrying bore 184 axially defined in an end of each crimping member 182. As shown in FIG. 9B, the alignment member 204 may include one or more magnets 210 configured to attract the crimping members 182 toward the second side 205*b* of the alignment member 204 while the carrying pins 208 of the tool 200 are inserted in the carrying bores 184 of the crimping members. The alignment member 204 can also include an alignment structure configured to interact with an alignment element of the support structure to provide substantial radial alignment between the engagement element of each of the crimping members and the corresponding engagement structure of the respective retainers. For example, the alignment structure of the alignment member can comprise at least one opening while alignment element of the support structure can comprise a protrusion. In one example, the opening of the alignment member comprises a pair of diametrically opposed the slots 206*a*, 206*b* configured to receive corresponding protrusions 113*a*, 113*b*, such as the head of a screw, extending from the front face of the front member 112 to provide rotational alignment between the crimping member set 180 and the retainers 142. Although two slots and two protrusions are illustrated, it is contemplated that a single slot and protrusion may be provided in examples discussed throughout the application and in further examples. Moreover, further examples, e.g., as discussed throughout the application, can include other types of openings, such as closed ended cavities, through holes, or other openings may be provided. Still further protrusions other than screws may be provided in further examples. Still further, it is contemplated that the alignment member may include one or more protrusions configured to be received in a corresponding opening formed in the support structure. It is also contemplated that a tongue and groove arrangement may be provided for the alignment structure and alignment element. It is also contemplated that a locking member may be provided to selectively inhibit relative axial movement between the tool and the support structure along the axis of the crimping apparatus in further examples.

Methods of crimping with the example crimping machine 500 and the example crimping apparatus 100 will now be described with reference to FIGS. 10-19. Portions of the crimping machine 500 and/or the crimping apparatus 100 may be shown in somewhat schematic form in FIGS. 10-19. Although not required in all embodiments, the connecting structure 160 of the crimping apparatus 100 can be designed to permit tooless removable mounting between the crimping apparatus 100 and the crimping machine 500. For example, as shown in FIGS. 10 and 11, the crimping apparatus 100 can be mounted on the crimping machine 500 or dismounted from the crimping machine 500 by moving the crimping apparatus 100 along a direction 106 that is substantially perpendicular to the axis 102 of the crimping apparatus 100. By way of a mounting movement, the slots 162*a*, 162*b* of the crimping apparatus 100 respectively receive the corresponding screws 502 extending from the press plate 504 of the crimping machine 500. In addition, the screw 164 of the crimping apparatus 100 is received by a corresponding slot (not shown) in the press plate 504. Once mounted, as shown in FIG. 11, the connecting structure 160 substantially inhibits a relative movement between the crimping apparatus 100 and the press plate 504 of the crimping machine 500 along the direction 104 that is substantially parallel to the axis 102 of the crimping apparatus 100.

Example methods of the present invention can include the step of selecting a crimping member set 180 from a plurality of alternative crimping member sets. The crimping member set 180 can be selected to accommodate a particular crimping arrangement. Once selected, the tool 200 is engaged with the crimping member set 180 to carry the crimping members 182 and help install the crimping members to the retainers 142. For example, as further shown in FIG. 11, the crimping member set 180 and crimping tool 200 of FIG. 7 can be aligned with the axis 102 of the crimping apparatus 100. The crimping member set 180 can then be inserted in direction 101*a* along the axis 102 until the crimping member set 180 is received within the interior area 103 of the crimping apparatus 100.

Figure 12:
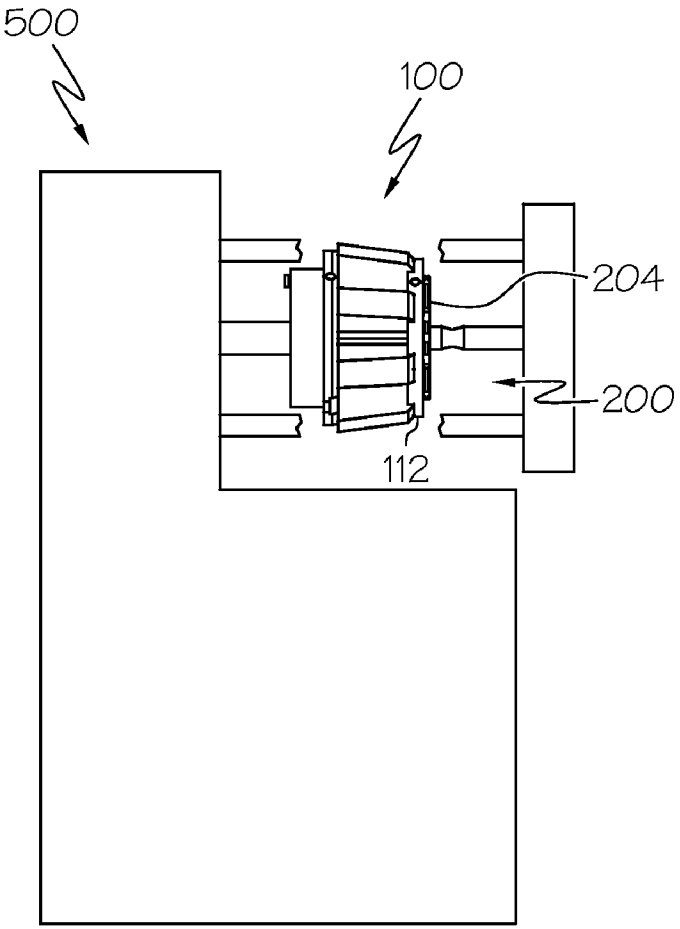
FIG. 12 depicts the crimping member set being inserted into an interior area of the crimping apparatus.

As shown in FIG. 12, once appropriately inserted, the alignment member 204 of the tool 200 abuts the front surface of the front member 112 to provide appropriate axial alignment between the crimping member set 180 and the retainers 142 of the crimping apparatus 100. Moreover, alignment protrusions 113*a*, 113*b* extending from the front surface of the front member 112 can be received in the corresponding slots 206*a*, 206*b* of the alignment member 204 to provide appropriate rotational alignment between the crimping member set 180 and the retainers 142. As shown in FIG. 12A, once the crimping member set 180 is rotationally and axially aligned with respect to the retainers 142, the protrusion 190 of each crimping member 182 is aligned with the corresponding aperture 152 of the engagement structure 150 of each retainer 142.

Figure 13A:
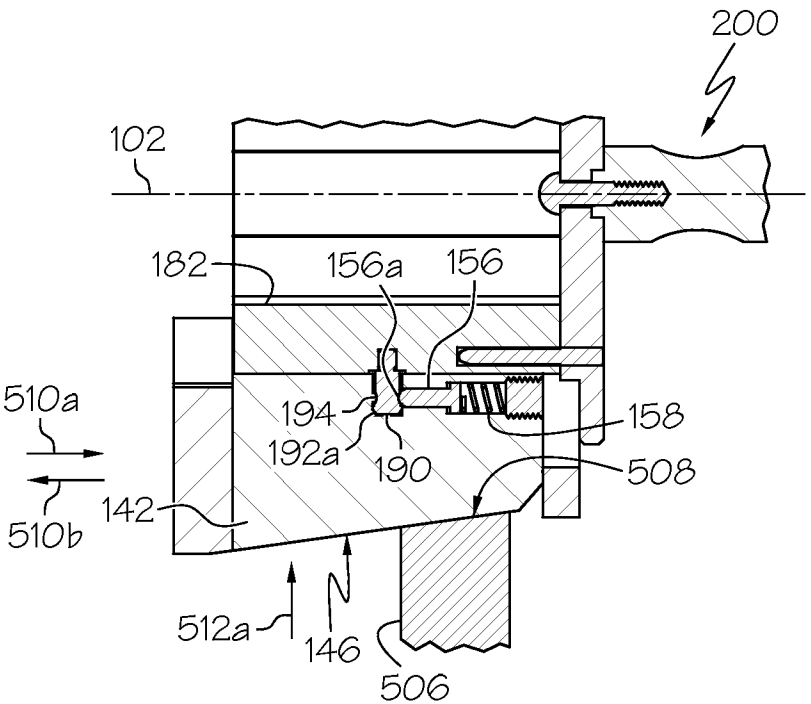
FIG. 13A depicts a partial sectional view of FIG. 13 illustrating the protrusion of the crimping member being received within the aperture and engaging a latch of the engagement structure.
Figure 13:
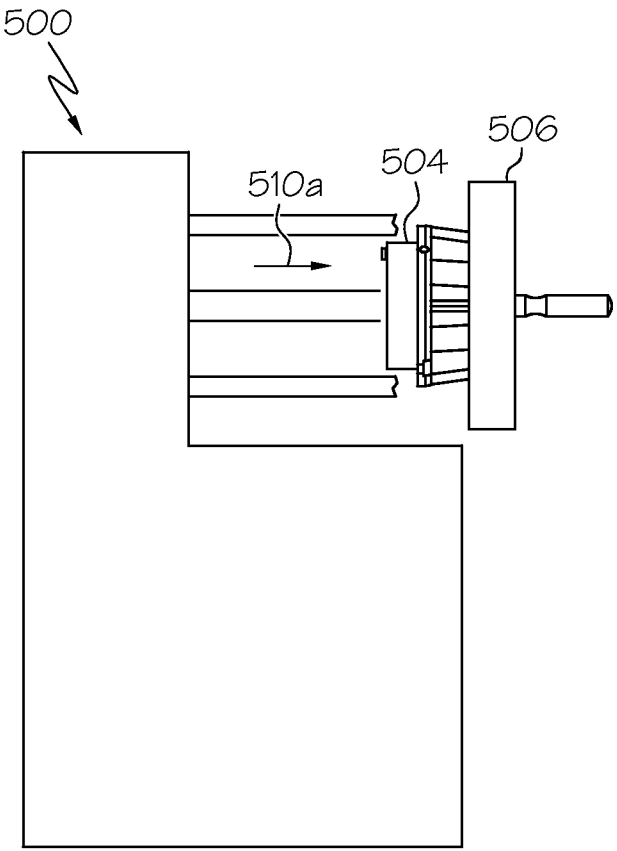
FIG. 13 depicts the retainers being pressed against a cam ring of the crimping machine to move the retainers toward the axis of the crimping apparatus.

After achieving axial and rotational alignment between the crimping member set 180 and the retainers 142, the crimping machine 500 is activated to push the retainers 142 in direction 510*a* against the cam ring 506 as shown in FIG. 13. As shown in FIG. 13A, a movement in direction 510*a* causes the cam surface 146 of each retainer 142 to slide against an inner surface 508 of the cam ring 506. Movement in the direction 510*a* therefore causes each retainer 142 to move in direction 512*a* toward the axis 102 of the crimping apparatus 100 against the bias of compression springs 145. After sufficient movement of each retainer 142 in direction 512*a*, the rounded end portion 156*a* of each pin 156 engages a beveled cam surface 192*a* of each protrusion 190. Further movement in direction 512*a*, presses the beveled cam surface 192*a* against the rounded end portion 156*a* of the pin 156 to cause portions of the pin 156 to move out of the aperture 152 against the bias of the spring 158. The rounded end portion 156*a* eventually biases back in the opposite direction to be received in the groove 194 of the protrusion 190. Once the end portion 156*a* is received in the groove 194 of the protrusion 190, the crimping member 182 is removably connected to the corresponding retainer 142 by the engagement structure 150 of the corresponding retainer 142.

It will be appreciated that the machine can be used to move the tool and the crimping member set in the opposite direction 510*b* can cause the crimping members 182 to disconnect from the retainers 142. Indeed, movement in the opposite direction 510*b* moves the retainers 142 out of engagement with the cam ring 506 of the crimping machine 500. Therefore, the compression springs 145 again bias the retainers 142 to extend outwardly away from the axis 102 of the crimping apparatus 100. As the tool 200 still engages the crimping members 182, the springs 145 cause another beveled cam surface 192*b* (see FIG. 12A) of each protrusion 190 to act against the rounded end 156*a* of each pin 156 to disengage each of the protrusions 190 from the corresponding latch of each retainer 142.

Figure 14A:
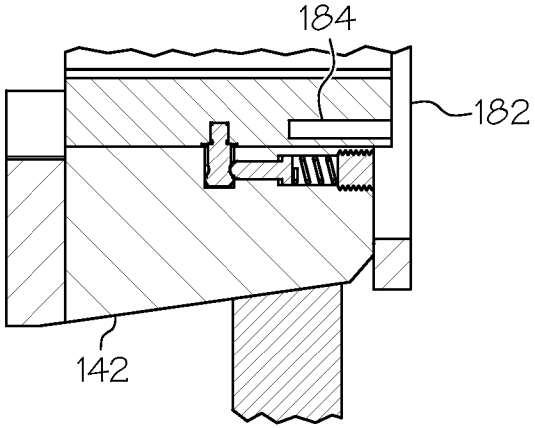
FIG. 14A depicts a partial sectional view of the crimping apparatus illustrated in FIG. 14.
Figure 14B:
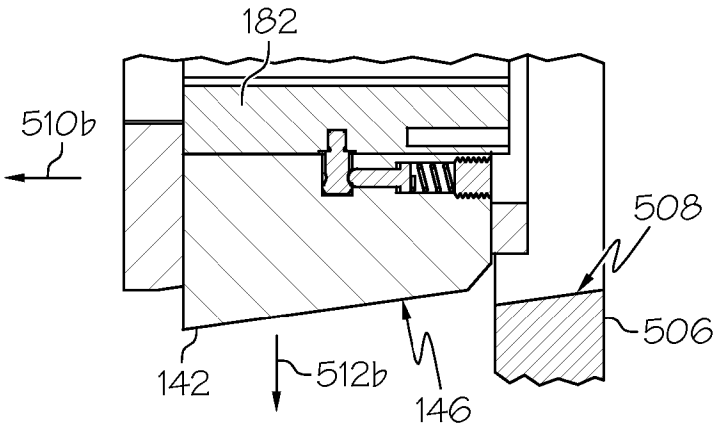
FIG. 14B depicts a partial sectional view of the crimping apparatus moved away from the cam ring such that the retainers, together with the crimping members move radially away from the axis of the crimping apparatus.
Figure 14:
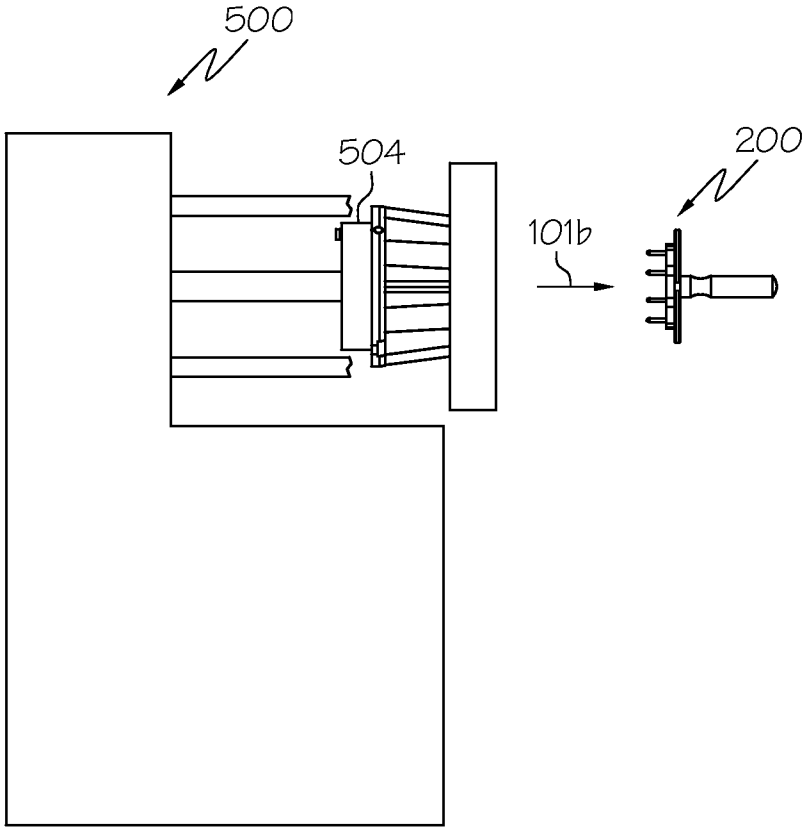
FIG. 14 depicts the tool of FIG. 13 being removed from the crimping member set.

Alternatively, the crimping members 182 can be left connected to the retainers 142. Indeed, as shown in FIGS. 14 and 14A, once the crimping members 182 are connected to the retainers 142, the tool 200 can be moved along direction 101*b* to disengage the carrying pins 208 of the tool 200 from the carrying bores 184 of each crimping member 182. As shown in FIGS. 14 and 14A, the tool 200 can be removed from the crimping member set 180 while each crimping member 182 remains connected to a corresponding one of the retainers 142. Next, as shown in FIG. 14B, the crimping machine 500 can be activated to move the press plate 504 along direction 510*b*. As the cam surface 146 of each retainer 142 is moved out of engagement with the inner surface 508 of the cam ring 506, the compression spring 145 (see FIG. 3C) causes the retainers 142 and connecting crimping members 182 to move in direction 512*b* to a retracted position. The crimping apparatus 100 is then configured to receive first and second element 600, 602 to be crimped by the predetermined crimping arrangement associated with the chosen crimping member set 180.

Figure 17:
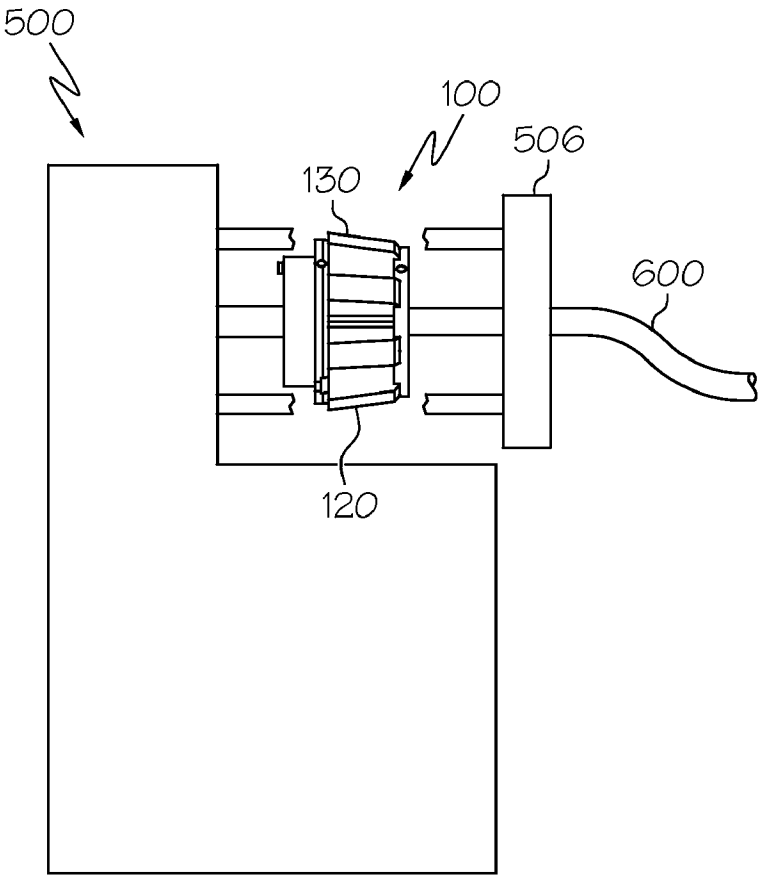
FIG. 17 depicts the second element and the end of the first element being inserted in the interior area with the second portion engaged with the first portion of the support structure just prior to crimping the second element to the first element.

As shown in FIG. 16, a second element 602 can be inserted over an end of the first element 600. Next, if size permits, the second element 602 and the end of the first element 600 can be inserted through the interior area of the cam ring 506 and, referring to FIG. 3, through the axial passage 108 and into the interior area 103 of the crimping apparatus 100. In further examples, if the support structure 110 is provided with a first portion 120 and a second portion 130, an oversized second element and end of the first element can be inserted though an alternative passage 109. For example, as shown in FIGS. 4 and 15, the second portion 130 can be moved out of engagement with the first portion 120 of the support structure 110. As shown in FIG. 16, the second element 602 and the end of the first element 600 can then be inserted through the interior area of the cam ring 506 and then through the alternative passage 109 of the crimping apparatus 100. Next, the second portion 130 is again reengaged with the first portion 120 to close the alternative passage 109 as shown in FIG. 17.

Figure 18:
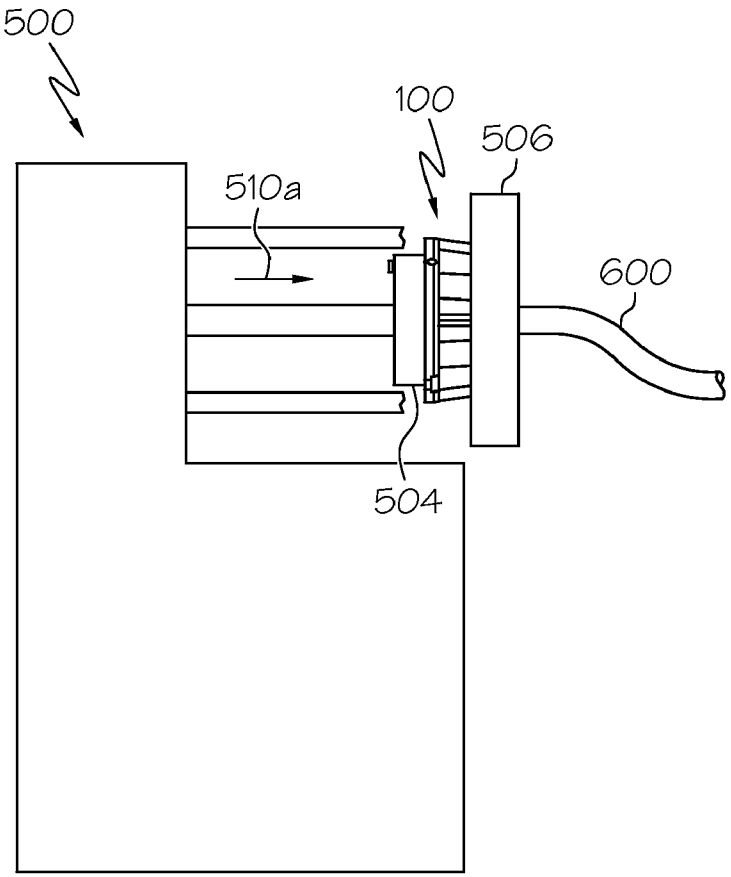
FIG. 18 depicts the retainers being pressed against the cam ring of the crimping machine to move the retainers and crimping members toward the axis of the crimping apparatus and thereby crimp the second element to the end of the first element.
Figure 19:
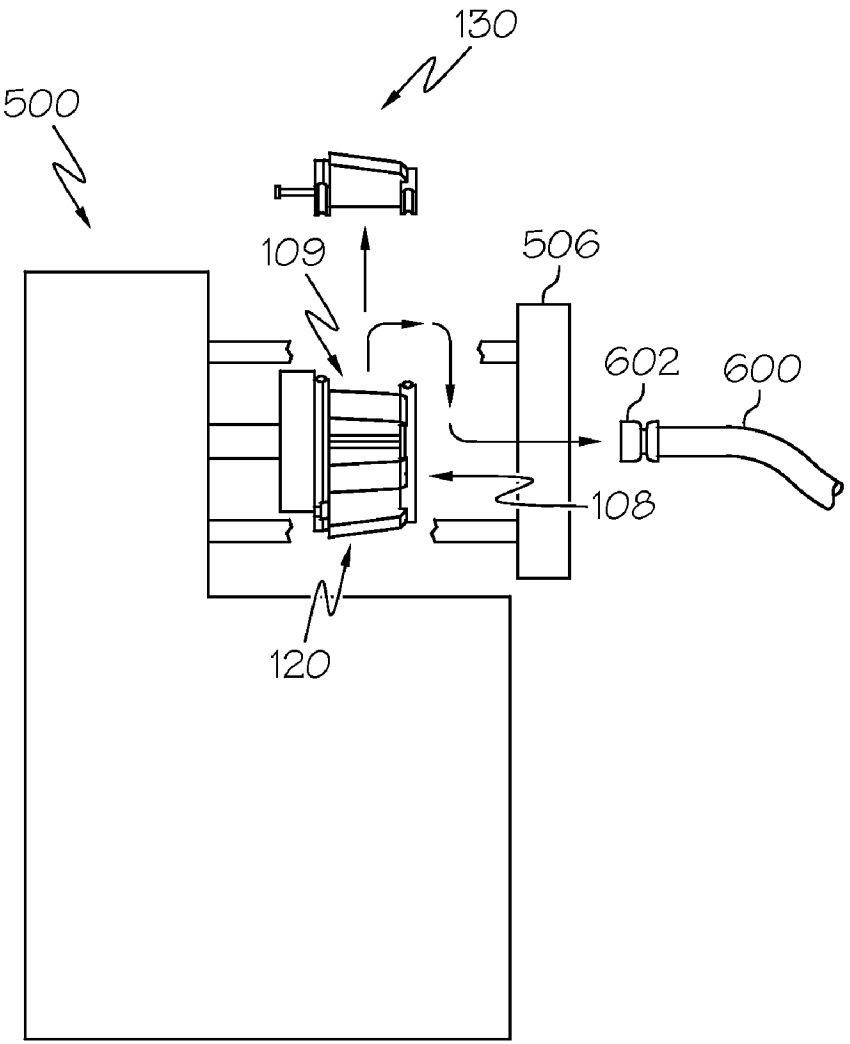
FIG. 19 depicts the second portion being moved completely out of engagement with the first portion and removing the second crimped element out of the interior area of the crimping apparatus by way of the alternative passage.

After appropriate positioning of the second element 602 and the end of the first element 600 into the interior area 103 of the crimping apparatus 100, the crimping machine 500 is again activated to push the retainers 142 and connected crimping members 182 in direction 510*a* against the cam ring 506 as shown in FIG. 18. Once sufficiently pushed in direction 510*a*, the crimping members 182 crimp the second element 602 to the first element 600. After crimping, the crimping machine 500 can be activated to move the crimping apparatus out of engagement with the cam ring 506 as shown in FIG. 19. The second element 602 and the end of the first element 600 can then be removed by way of the axial passage 108 (see FIG. 3). Alternatively, if the support structure 110 is provided with first and second portions 120, 130, the second portion 130 can be moved relative to the first portion 120 to create an alternative passage 109 (see FIG. 4). Next, the second element 602 and the end of the first element 600 can then be removed by way of the alternative passage 109.

FIGS. 20-27 depict aspects of another example crimping apparatus 700 including further aspects of the present invention. Unless otherwise illustrated or discussed herein, structure and/or function of the crimping apparatus 700 can be similar or identical to the structure and/or function of the crimping apparatus 100 discussed above.

Figure 20:
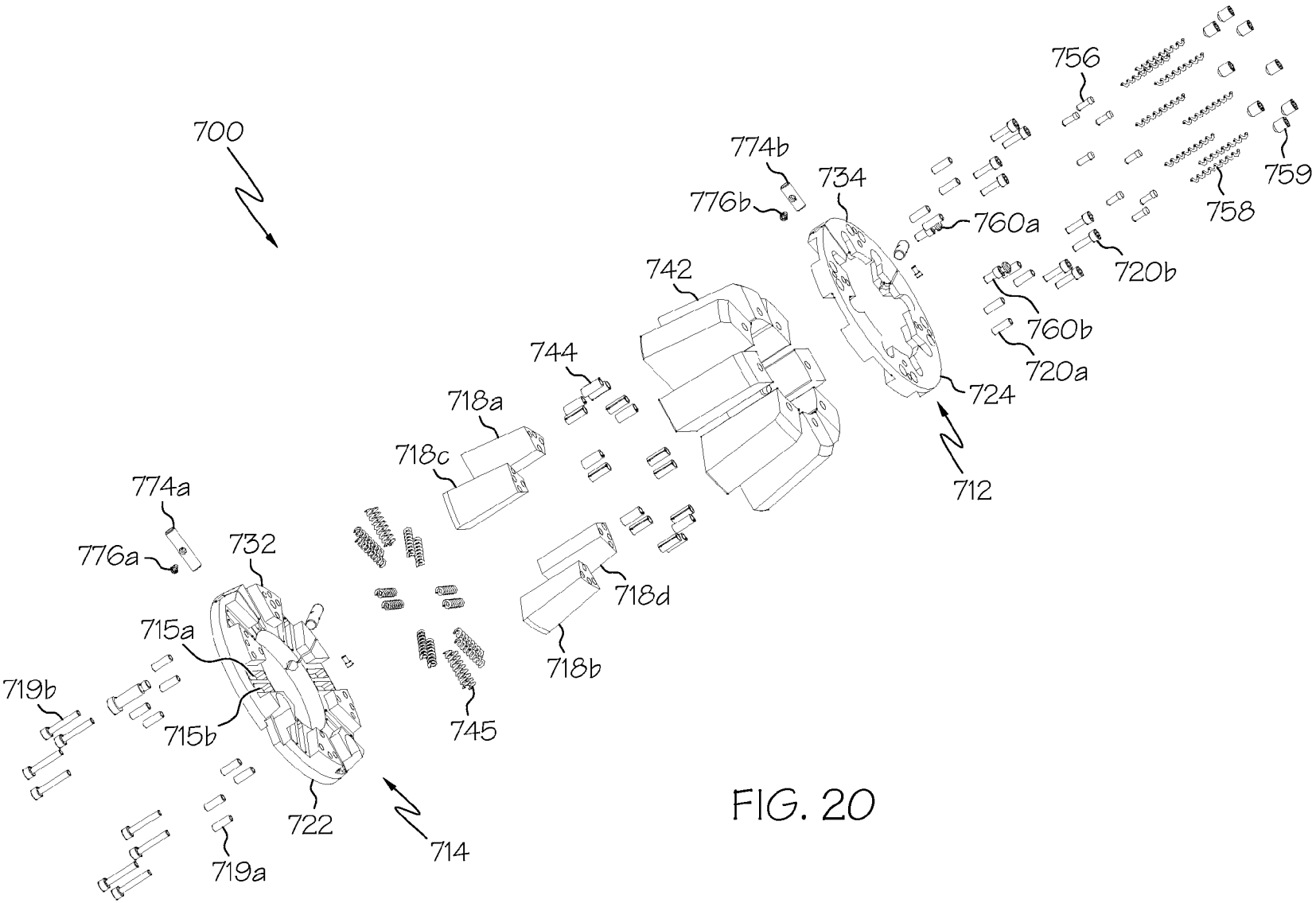
FIG. 20 depicts an exploded perspective view of portions of another example of a crimping apparatus in accordance with aspects of the present invention.

The crimping apparatus 700 can include a support structure with a plurality of die members movably attached to the support structure. As shown, examples of support structure can include a front member 712 and a rear member 714 that is attached, such as fixedly attached, to the front member 712. As further illustrated, the spacers can comprise a plurality of spacer blocks 718*a*, 718*b*, 718*c*, 718*d* positioned between at least portions of the front and rear member. Providing four, rather than two, spacer blocks can enhance the structural integrity of the support structure can comprise a structure similar to the spacer blocks 118*a*, 118*b* described with respect to the crimping apparatus 100. As shown in FIG. 20, one or more alignment pins 719*a* can be provided to help position the rear member 714 with respect to each corresponding end of the spacer blocks 718*a*, 718*b*, 718*c*, 718*d*. Moreover, one or more screws 719*b* may be provided to attach the rear member 714 to each corresponding end of the spacer blocks 718*a*, 718*b*, 718*c*, 718*d*. Likewise, similar alignment pins 720*a* and screws 720*b* may also be provided to similarly help position and attach the front member 712 with respect to each corresponding end of the spacer blocks 718*a*, 718*b*, 718*c*, 718*d*.

As also shown, the crimping apparatus 700 can include an optional registration structure to facilitate a predetermined orientation between first and second portions of the support structure. Although a wide variety of registration structures may be employed, in the illustrated example, opposed grooves are machined into abutting locations of the first and second portions. Another piece, e.g., a registration pin 774*a*, 774*b*, may be fastened to one of the grooves to define a tongue portion. For instance, as shown in FIG. 20, the rear member 714 comprises two tongue and groove structures that are each defined by a registration pin 774*a* and two grooves adapted to each simultaneously receive portions of the registration pin 774*a*. The registration pin 774*a* can be mounted with respect to one of the grooves, for example, by a screw 776*a* configured to extend through a counterbore in the registration pin 774*a* to mount the registration pin 774*a* with respect to the second rear member 732. Once mounted, a portion of a corresponding registration pin 774*a* longitudinally extends within the corresponding groove defined in the second rear member 732. Another portion of each corresponding registration pin 774*a* extends out of the corresponding groove to define the tongue portion of the tongue and groove structure. The tongue portion is configured to be received in a corresponding groove defined in the first rear member 722. Therefore a predetermined orientation may be achieved between the first and second rear members 722, 732 by way of one or more tongue and groove structures and/or other registration structures.

In addition, or alternatively, the front member 712 can be provided with one or more tongue and groove structures or other registration structures. As shown in FIG. 20, the illustrative example of the front member 712 comprises two tongue and groove structures that are each defined by a registration pin 774*b* and two grooves adapted to each simultaneously receive portions of the registration pin 774*b*. Each tongue and groove structure can comprise a groove defined in the first front member 724 and a groove defined in the second front member 734. A registration pin 774*b* of each tongue and groove structure can be mounted with respect to one of the grooves, for example, as described with respect to the registration pin 774*a* above. For instance, a screw 776*b* can be provided to extend through a counterbore in the registration pin 774*b* to mount the registration pin 774*b* with respect to the second front member 734. Once mounted, a portion of a corresponding registration pin 774*b* longitudinally extends within the corresponding groove defined in the second front member 734. Another portion of each corresponding registration pin 774*b* extends out of the corresponding groove to define the tongue portion of the tongue and groove structure. The tongue portion is configured to be received in a corresponding groove defined in the first front member 724. Therefore, like the first and second rear members 722, 732, a predetermined orientation may be achieved between the first and second front members 724, 734 by way of one or more tongue and groove structures and/or other registration structures. As shown, each tongue includes a cylinder of substantial semicircular cross section while the groove comprises a substantial semicircular groove configured to receive the tongue. In further examples, the tongue and groove may comprise other shapes such as rectangular, square, triangular or other cross sectional shapes.

Figure 21:
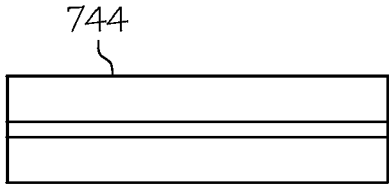
FIG. 21 depicts a side view of an example guide pin.
Figure 22:
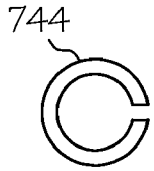
FIG. 22 depicts an end view of the guide pin of FIG. 21.
Figure 23:
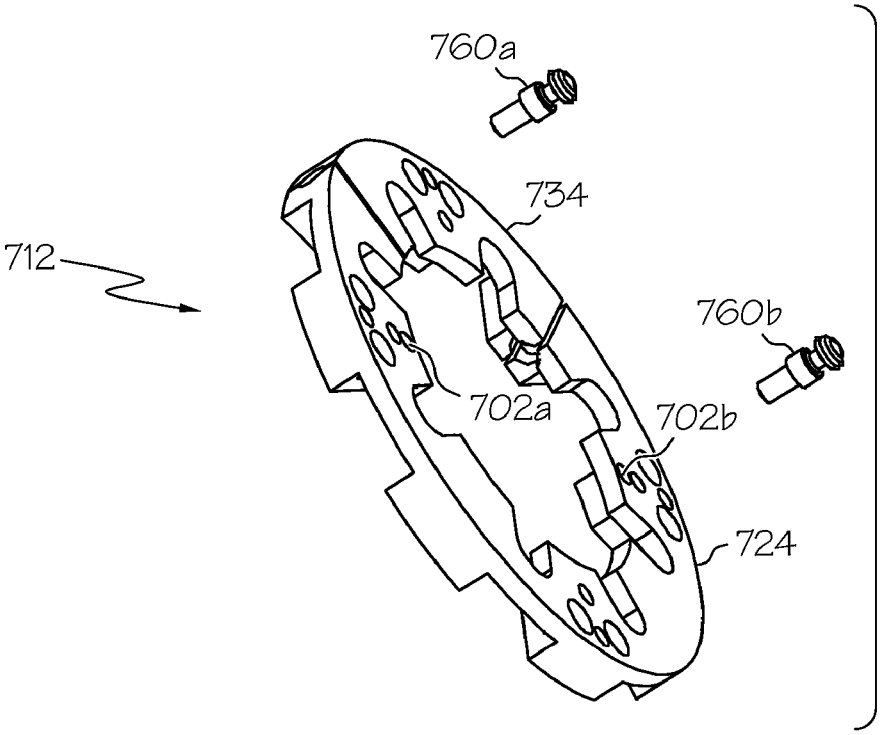
FIG. 23 depicts a perspective view of an example front member and alignment protrusions exploded from the front member.

As with the crimping apparatus 100, the front member 712 and the rear member 714 of the crimping apparatus 700 can be configured to permit movable attachment of retainers 742. For instance, the front member 712 can comprise a plurality of guide channels radially arranged about the axis of the crimping apparatus 700. Each of the guide channels can slidingly receive a first end portion of a corresponding retainer 742 to allow each retainer 742 to move with respect to the support structure in a direction toward and away from the axis of the crimping apparatus 700. The rear member 714 can comprise a pair of guide channels 715*a*, 715*b* associated with each retainer 742 that are configured to receive an end of a corresponding guide pin 744 to define the maximum and minimum movements of the retainers 742. In one example, the guide pins 744 can have a C-shaped construction as illustrated in FIGS. 21 and 22. Although a pair of guide channels 715*a*, 715*b* are illustrated, it is understood that a single or more than two guide channels may be associated with each retainer 742. Each of the guide channels 715*a*, 715*b* are configured to receive an end of a guide pin 744 extending from a second end portion of a corresponding retainer 742 to limit movement of the retainers 742. One or all of the guide channels 715*a*, 715*b* associated with each retainer 742 may include a biasing member, such as a compression spring 745. A compression spring 745 can be positioned in each of the guide channels 715*a*, 715*b* to act against the guide pins 744 to bias each retainer 742 away from the axis, thereby maximizing the interior area of the crimping apparatus 700. Each of the guide channels 715*a*, 715*b* may be provided with a similar compression spring 745 to increase the force exerted on the retainers 742. As with the retainers 142 of the crimping apparatus 100, each retainer 742 of the crimping apparatus 700 can also include one side comprising a cam surface that flares outwardly from the axis in a direction from the first end portion to the second end portion of the retainer 742.

The die members of the crimping apparatus 700 can be constructed in a similar manner with respect to the die members of the crimping apparatus 100 described above. For example, the crimping apparatus 700 can include die members with retainers 742 that are configured to removably connect a separate crimping member 182 to the retainer 742. The retainers 742 can also include an engagement structure similar to the engagement structure 150 described with respect to the retainers 142 of the crimping apparatus 100 described above. For example, the engagement structure of the retainers 742 can comprise a similar or identical latch configured to engage the protrusion the protrusion 190 of the crimping member 182 to removably connect the crimping member 182 to the retainer 742. As shown, the latch can include a pin 756 and compression spring 758 configured to extend within a corresponding bore of the retainer 742. An end cap 759 is threaded into an end of the bore to retain the spring 758 and the pin 756 and to provide a precompression to the spring 758 to bias the end portion of the pin 756 into the aperture.

As described above, each crimping member 182 of a crimping member set 180 may be simultaneously attached to a corresponding one of each of the retainers 142. For example, FIG. 7 illustrates a crimping member set 180 being supported by an optional tool 200 for simultaneously attaching each crimping member 182 of a crimping member set 180 to a corresponding one of the retainers 142. FIGS. 28-41 illustrate another example of a tool 800 in accordance with another example of the present invention configured to simultaneously attach a plurality of crimping members 182 of a crimping member set 180 to a corresponding retainer 742 of the crimping apparatus 700. Moreover, as shown for example in FIGS. 20, 23 and 24, the support structure of the crimping apparatus 700 can include an alignment element, such as alignment protrusions 760*a*, 760*b*, configured to interact with an alignment structure of the tool 800 to provide substantial radial alignment between the engagement element of each of the crimping members and the corresponding engagement structure of the respective retainers 742.

Figure 24:
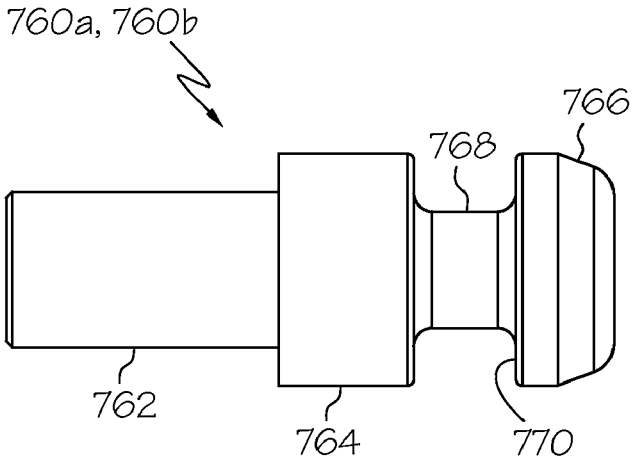
FIG. 24 depicts an example alignment protrusion.
Figure 25A:
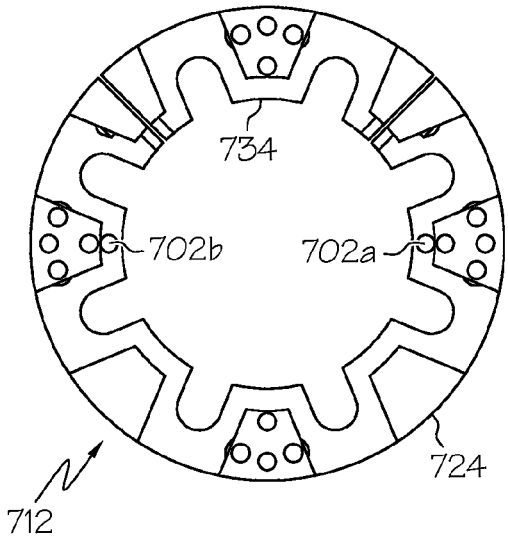
FIG. 25A depicts a rear view of an example front member.
Figure 25B:
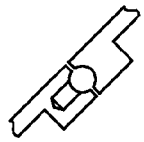
FIG. 25B depicts portions of a side view of the front member from FIG. 25A.
Figure 27:
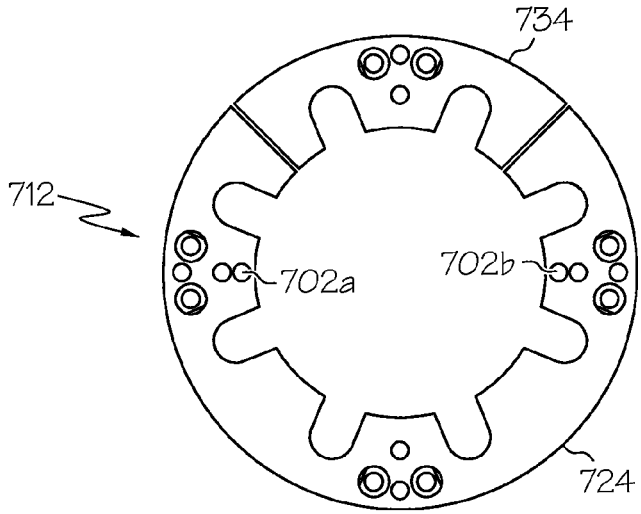
FIG. 27 depicts a front view of the front member of FIG. 25A.
Figure 26:
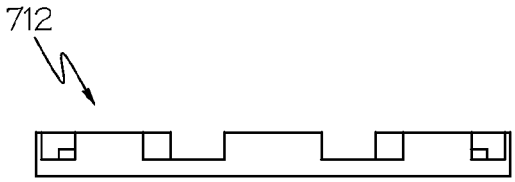
FIG. 26 depicts a side view of the front member of FIG. 25A.

Each of the alignment protrusions 760*a*, 760*b*, if provided, can be identical to one another with structure illustrated in FIG. 24. Although two alignment protrusions are illustrated, it is contemplated that one or more than two alignment protrusions may be provided in further examples. As shown, the alignment protrusions 760*a*, 760*b* can include a threaded portion 762 configured to be threadingly received in corresponding apertures 702*a*, 702*b* in the front member 712. Each of the alignment protrusions 760*a*, 760*b* can also include an alignment portion 764 extending from the threaded portion 762. The alignment protrusions can further include a locking head 766 attached to the alignment portion 764 by way of a reduced neck portion 768. The locking head 766 can have an enlarged dimension with respect to a corresponding reduced dimension of the neck portion to define a shoulder 770 configured for locking with the tool 800 as described more fully below. As shown, the enlarged dimension of the locking head and/or the reduced dimension of the neck portion can comprise corresponding diameters of corresponding cross-sectional areas through respective parallel cross-sectional planes respectively passing through the locking head and neck portion.

The tool 800 is configured to simultaneously support the crimping members 182 of the set of crimping members 180 for simultaneous attachment to the corresponding retainers 742. Unless otherwise illustrated or discussed herein, structure and/or function of the tool 800 can be similar or identical to the structure and/or function of the tool 200 discussed above.

Figure 35:
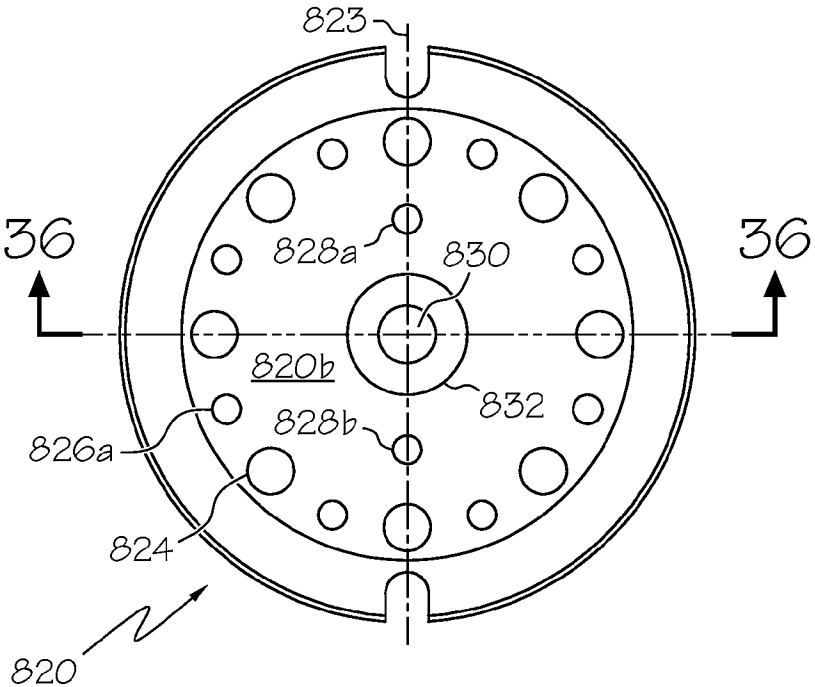
FIG. 35 depicts a second side of the first member of FIG. 34.
Figure 36:
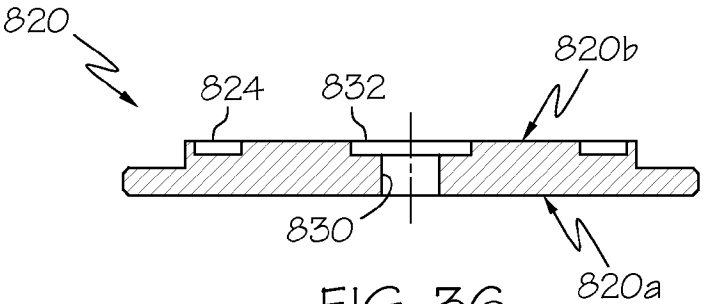
FIG. 36 depicts a sectional view of the first member along line 36-36 of FIG. 35.
Figure 34:
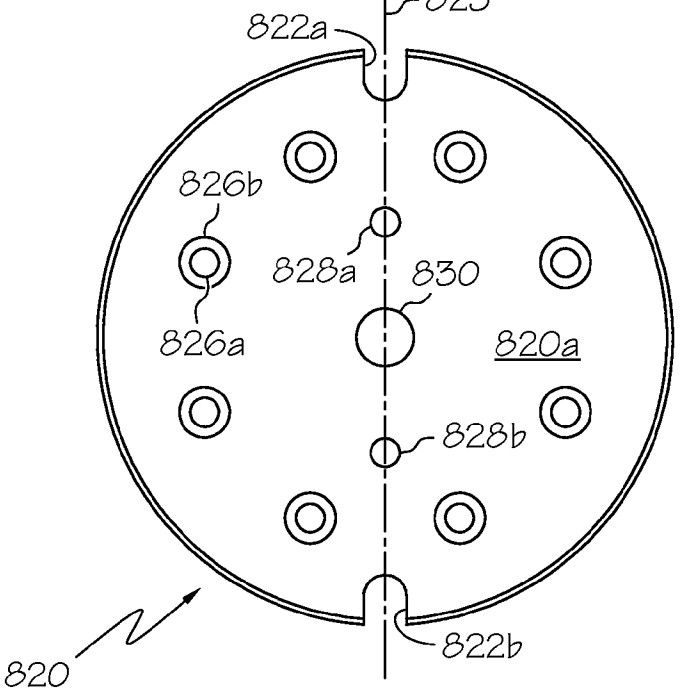
FIG. 34 depicts a first side of an example first member of the tool of FIG. 28.

As shown in FIGS. 34-36, the tool 800 can include a first member 820 that can act as a support member and/or an alignment member. As shown, the first member 820 can be substantially circular although the first member may have a rectangular or other shape in further examples. Unless otherwise illustrated or discussed herein, structure and/or function of the first member 820 can be similar or identical to the structure and/or function of the alignment member 204 of the tool 200 discussed above. Moreover, the alignment member 204 can additionally or alternatively act as a support member of the tool 200. FIG. 34 depicts a first side 820*a* of the first member 820 while FIG. 35 illustrates a second side 820*b* of the first member 820.

As shown in FIGS. 34-35, the first member 820 can comprise an alignment member with an alignment structure configured to interact with the alignment element of the support structure to provide substantial radial alignment between the engagement element of each of the crimping members and the corresponding engagement structure of the respective retainers. The alignment structure can comprise a protrusion, groove, or other structure configured to interact with corresponding alignment element of the support structure. In one example, the alignment structure of the first member 820 can comprise at least one opening configured to receive at least one corresponding protrusion of the support structure. As shown, in one example, the at least one opening can include a pair of alignment slots 822*a*, 822*b* that, in one example, can be disposed along an alignment axis 823. Each of the alignment slots 822*a*, 822*b* can be configured to receive a corresponding alignment portion 764 of respective alignment protrusions 760*a*, 760*b* of the support structure.

Figure 41:
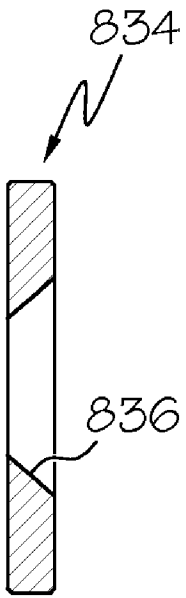
FIG. 41 depicts a sectional view of the washer along line 41-41 of FIG. 40.
Figure 40:
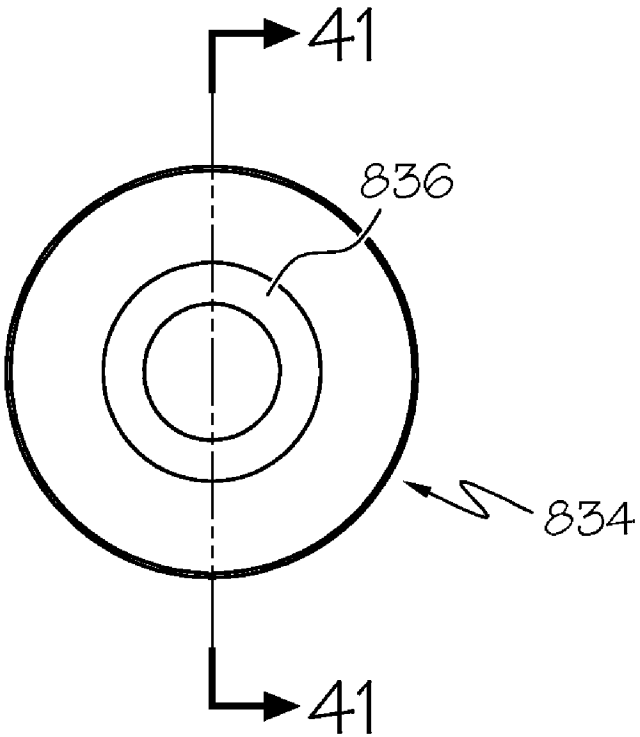
FIG. 40 depicts a top view of an example washer of the tool of FIG. 28.

The first member 820 can also include a first bore 828*a* and second bore 828*b* can be substantially identical to one another and can also be disposed along the alignment axis 823. The first member 820 can further include a plurality of radially arranged apertures 826*a* extending between the first and second sides 820*a*, 820*b*. Furthermore, the first side 802*a* can include a counterbore 826*b* associated with each of the apertures 826*a*. In addition, the first member 820 can include an aperture 830 extending through the center of the first member 820 and configured to receive a shank 808 of an optional handle 802. The second side 820*b* of the first member 820 can also include a counter bore 832 configured to receive a washer 834. FIGS. 40 and 41 illustrate an example washer 834 including a counter bore 836 configured to receive the head of a screw 838 shown in FIG. 28.

The second side 820*b* of the first member 820 can also include a plurality of radially arranged recesses 824 that are each disposed between a pair of adjacent apertures 826*a*. Each recess 824 is configured to receive a corresponding magnet 825 (see FIG. 28). The plurality of magnets 825 are configured to attract the plurality of crimping members 182 of the crimping member set 180 toward the second side 820*b* of the first member 820.

Figure 28:
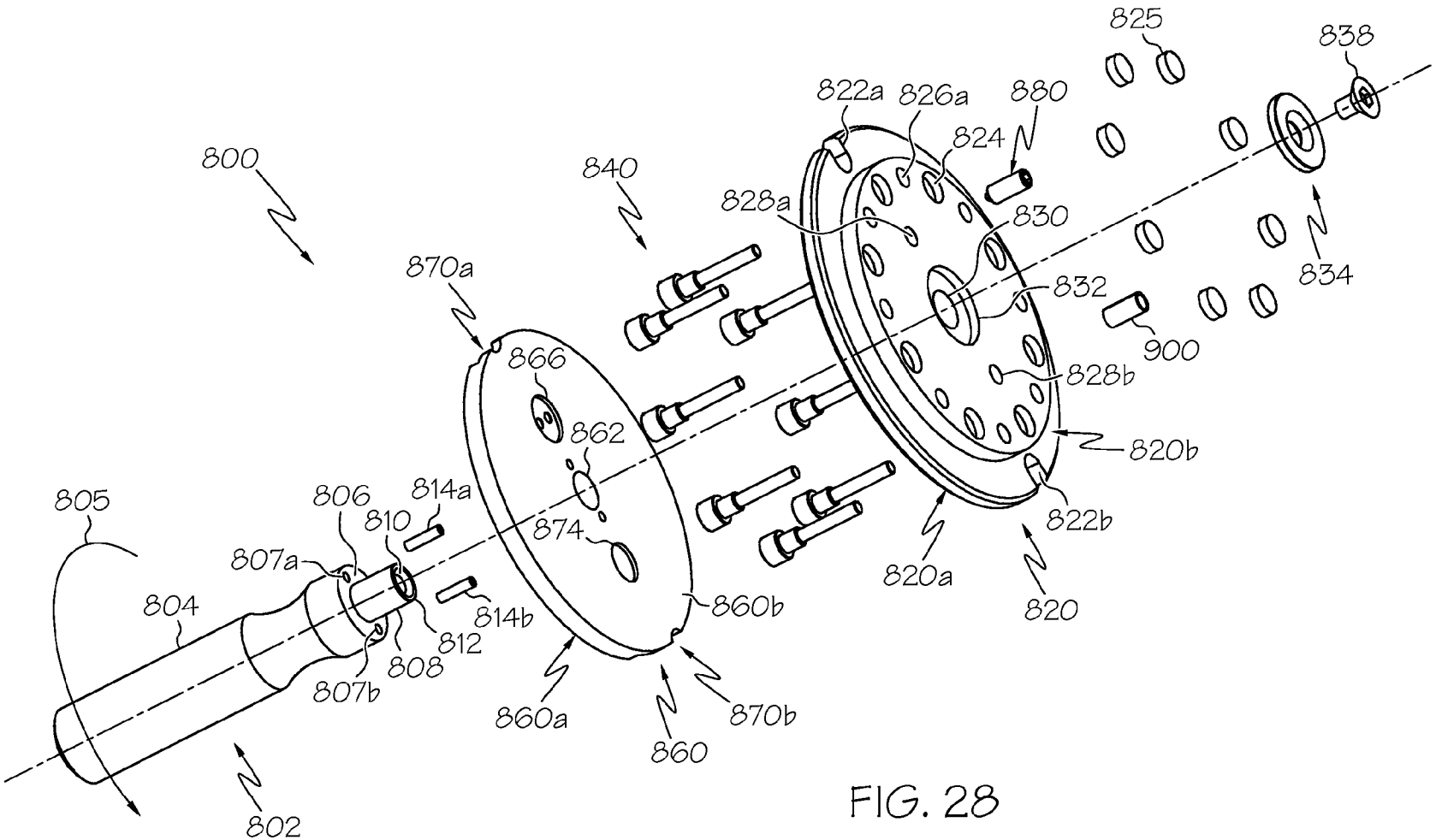
FIG. 28 depicts a perspective exploded view of an example of another tool in accordance with further aspects of the present invention.
Figure 37:
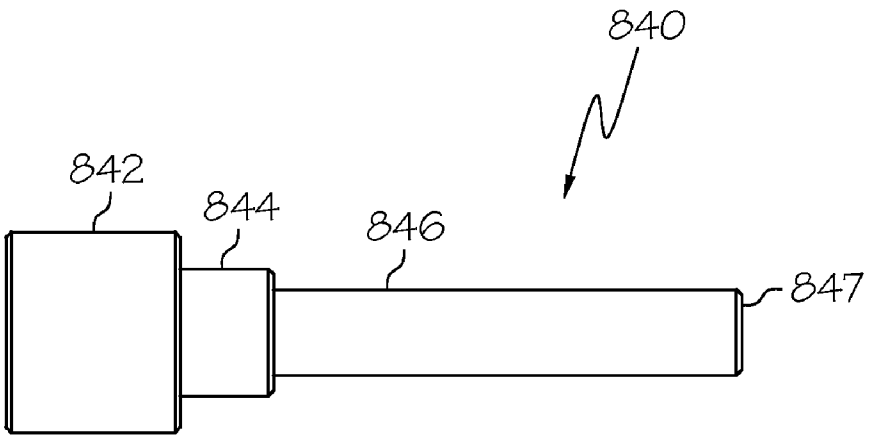
FIG. 37 depicts a side view of an example carrying pin of the tool of FIG. 28.
Figure 38:
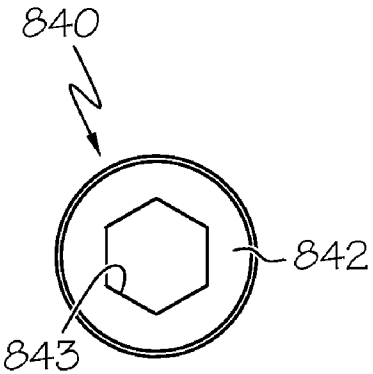
FIG. 38 depicts an end view of the carrying pin of FIG. 37.

As shown in FIG. 28, the tool 800 can also include a plurality of carrying pins 840. Unless otherwise illustrated or discussed herein, structure and/or function of the carrying pins 840 can be similar or identical to the structure and/or function of the carrying pins 208 of the tool 200 discussed above. FIGS. 37 and 38 illustrate one example of a carrying pin 840 that can be used in accordance with aspects of the present invention. As shown, the carrying pin 840 can include a head portion 842 with a tool recess 843 configured to receive a portion of a tightening tool. The head portion 842 is also configured to be received in the counter bore 826*b* in the first side 820*a* of the first member 820. The carrying pin 840 further includes a threaded portion 844 configured to be threadedly received in the aperture 826*a* of the first member 820. Still further, the carrying pin 840 includes a carrying portion 846 configured to extend through the aperture 826*a* to extend from the second side 820*b* of the first member 820.

Figure 30:
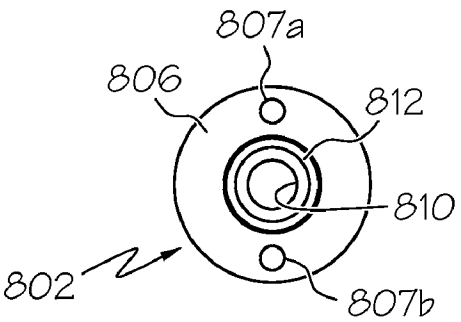
FIG. 30 depicts an end view of the example handle of FIG. 29.
Figure 29:
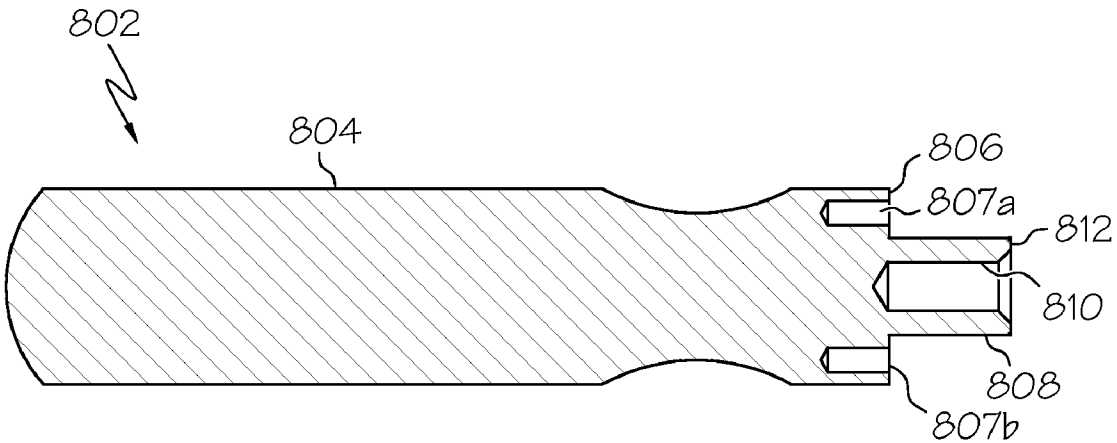
FIG. 29 depicts a sectional view of an example handle of the tool of FIG. 28.

As shown in FIGS. 28-30, the tool 800 can include a handle 802 with a grip portion 804 that may be knurled or otherwise textured to facilitate griping and rotation of the handle. The handle 802 can further include a shank 808 extending from a shoulder 806. A pair of alignment bores 807*a*, 807*b* may be defined in the face of the shoulder 806 and can be configured to receive portions of corresponding alignment pins 814*a*, 814*b*. In one example, the alignment pins 814*a*, 814*b* can comprise a C-shaped construction similar to the guide pin 744 illustrated in FIGS. 21 and 22. The handle 802 can further include a threaded bore 810 configured to threadingly receive a threaded portion of a screw 838 and a shank edge 812 configured to abut a surface of a washer 834.

As further shown in FIGS. 28 and 31-33, the tool 800 can further include a locking member configured to selectively lock the tool with respect to the support structure. In one example, the locking member can be configured to selectively engage a support structure of a crimping apparatus to selectively lock the position of the support member with respect to the support structure. In another example, the locking member can be configured to selectively inhibit relative axial movement between the tool and the support structure along the axis of the crimping apparatus.

As shown in the illustrated example, the locking member 860 can comprise a locking plate although other configurations may be provided in further examples. As shown, the locking member can be substantially circular although the locking member may have a rectangular or other shape in further examples. As further illustrated, in one example, both the first member 820 and the locking member 860 can be substantially circular and concentrically mounted with respect to one another. The locking member 860 can include a first side 860*a* and a second side 860*b* and a central through bore 862 sized such that the shank 808 may extend through the central bore 862. The locking member 860 can further include a pair of through bores 864*a*, 864*b* configured to be aligned with the alignment bores 807*a*, 807*b* of the handle 802 and further configured to receive portions of the alignment pins 814*a*, 814*b* to permit the handle 802 to be fixedly attached to the locking member 860.

Figure 33:
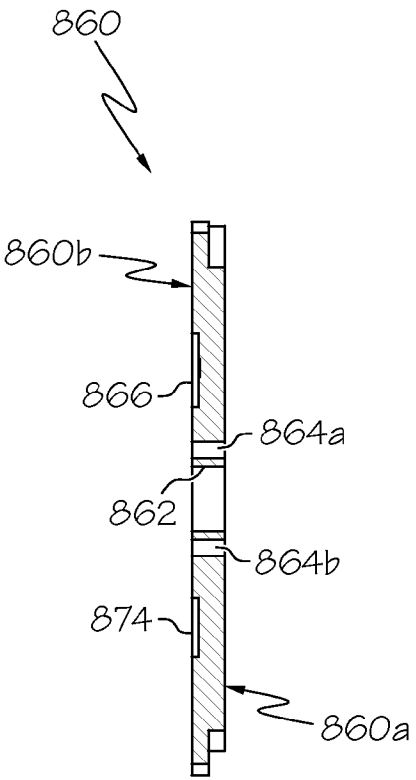
FIG. 33 depicts a sectional view of the locking member along line 33-33 of FIG. 32.
Figure 31:
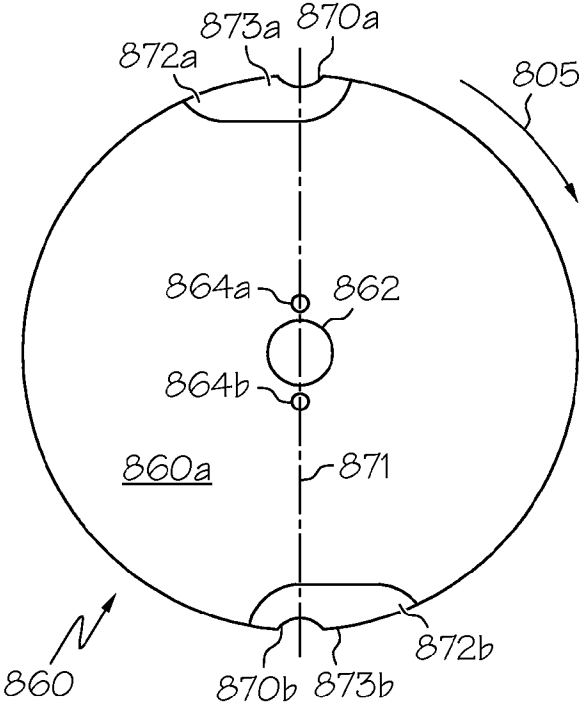
FIG. 31 depicts a first side of an example locking member of the tool of FIG. 28.

As shown, in one example, the locking member 860 can be configured to selectively engage at least one alignment protrusion of the support structure of the crimping apparatus to selectively inhibit relative axial movement between the tool and the support structure along the axis of the crimping apparatus. In one example, the locking member 860 is rotatably mounted with respect to the support member, wherein the locking member includes a locking surface configured to selectively engage a support structure, such as a protrusion of the support structure, to selectively lock the position of the support member with respect to a support structure. As shown in FIG. 31, the locking member 860 can include at least one locking surface 873*a*, 873*b* configured to selectively engage the shoulder 770 of the alignment protrusions 760*a*, 760*b* to selectively lock the position of the first member 820 with respect to the support structure of the crimping apparatus 700. In one example, as shown in FIGS. 31 and 33, the first side 860*a* of the locking member 860 can include first and second recesses 872*a*, 872*b* that include the locking surfaces 873*a*, 873*b*. The locking member 860 can also include first and second slots 870*a*, 870*b* that can extend between the first and second sides 860*a*, 860*b* of the locking member 860 and can be aligned along an alignment axis 871. The slots 870*a*, 870*b* can allow passage of the locking heads 766 of the alignment protrusions 760*a*, 760*b* as the tool 800 is axially inserted with respect to the support structure along the axis of the crimping apparatus 700. In one example, the locking member 860 includes at least one opening, such as the slots 870*a*, 870*b*, wherein the locking member 860 is configured to be rotated relative to the first member 820, such as a support member, between an unlocked position and a locked position. In the locked position, the opening, such as the slots 870*a*, 870*b*, of the locking member 860 is substantially aligned with an opening, such as the respective slots 822*a*, 822*b* of the first member 820. In the locked position, the opening, such as the slots 870*a*, 870*b*, of the locking member 860 is substantially misaligned with the opening, such as the respective slots 822*a*, 822*b* of the first member 820. As described below, the first and second slots 870*a*, 870*b* and the first and second locking surface 873*a*, 873*b*, for example, associated with the slots 870*a*, 870*b*, can be configured to facilitate selective locking of the tool 800 to the crimping apparatus 700.

Figure 32:
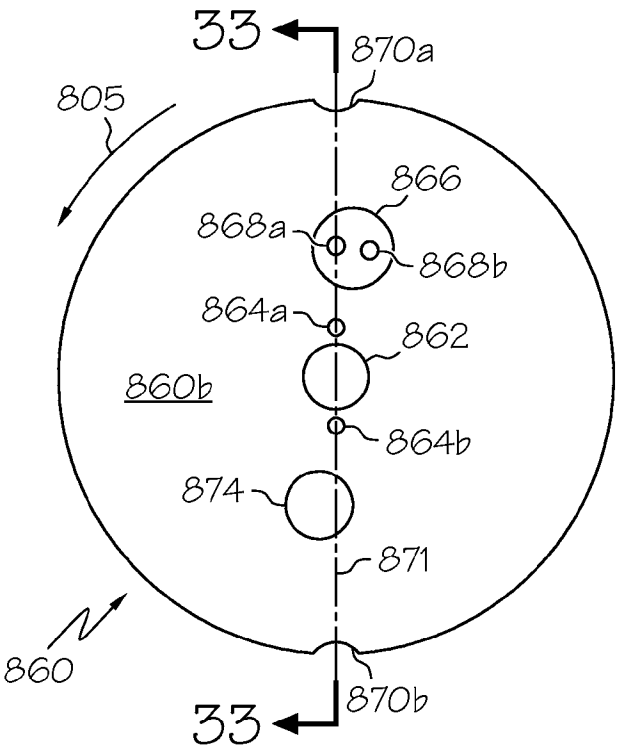
FIG. 32 depicts a second side of the example locking member of FIG. 31.

As shown in FIGS. 32 and 33, the second side 860*b* of the locking member 860 can include a first cavity 866 that, in one example, can include a pair of apertures 868*a*, 868*b*. As best shown in FIG. 32, the first aperture 868*a* can be aligned along the alignment axis 871 while the second aperture 868*b* can be radially displaced with respect to the first aperture 868*a* in a clockwise direction as shown in FIG. 32. It is also noted that the first cavity 866 can comprise a circular cavity with a center that is also radially displaced another distance in a clockwise direction as shown in FIG. 32 with the center of the cavity 866 located substantially between the first and second apertures 868*a*, 868*b*. The second side 860*b* can also include a second cavity 874. In some examples, the second cavity 874 may be identical or geometrically similar to the first cavity 866. As shown, the second cavity 874 can comprise a circular cavity with a center that is located 1800 with respect to center of the first cavity 866 about the center of the locking member 860. Although not shown, further examples can include a second cavity that is located at angles other than 1800 with respect to the first cavity 866. It is also understood that one or more noncircular cavities may be incorporated in further examples.

Figure 39:
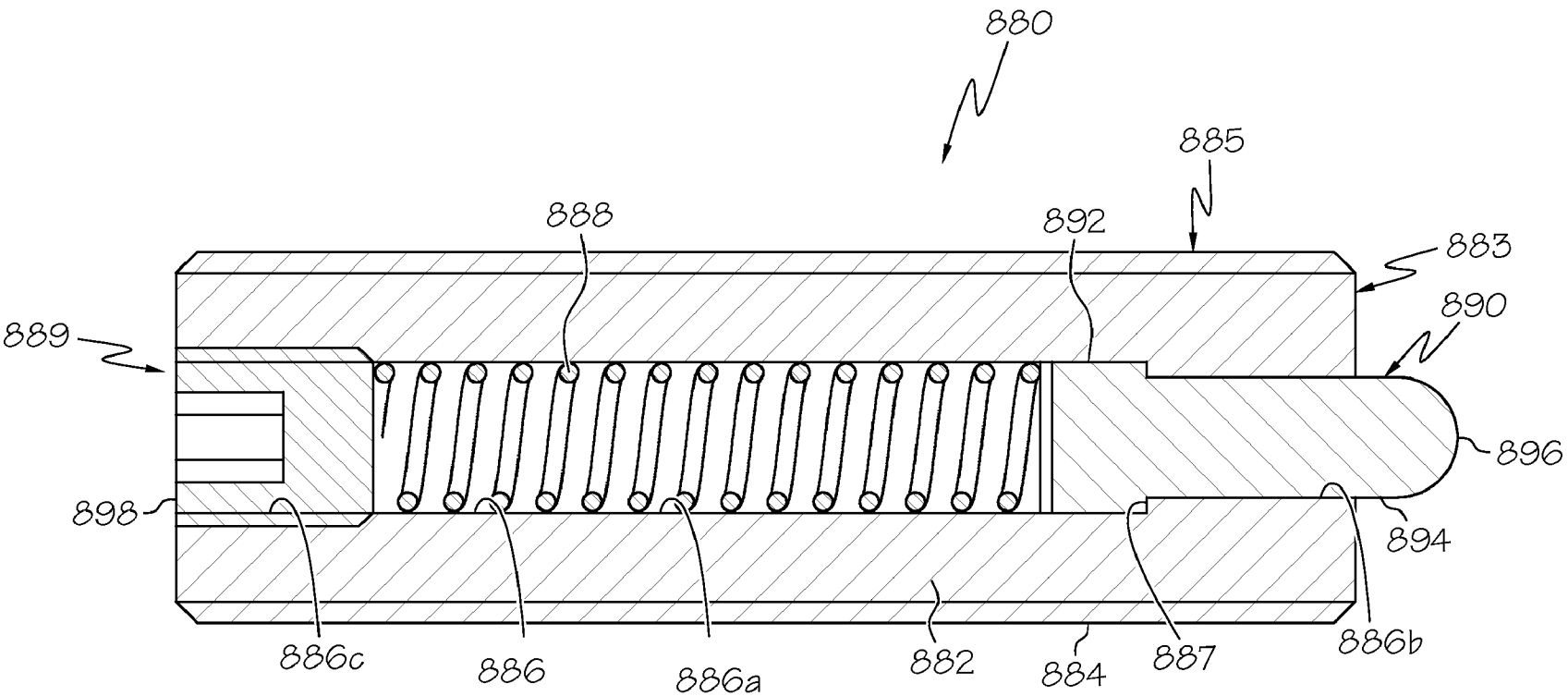
FIG. 39 depicts an example of a first stop device of the tool of FIG. 28.

FIGS. 28 and 39 illustrate an example first stop device 880 that may be used in example tools of the present invention. The first stop device 880, if provided, can include a body 882 with a threaded outer surface portion 884 configured to be threadingly received in the first bore 828*a* of the first member 820. The body 882 can include an inner bore 886 with a first portion 886*a* having a first inner diameter and a second portion 886*b* having a second diameter that is less than the first diameter. The inner bore 886 can further include a threaded portion 886*c* configured to threadingly receive a threaded end cap 898. The first stop device 880 can further include a pin 890 with an enlarged end 892 and a rounded end 896 disposed at the opposite end of the pin 890. A central portion 894 of the pin 890 can be configured to reciprocate with respect to the second portion 886*b* of the inner bore 886. The enlarged end 892 can also be configured to reciprocate within the first portion 886*a* of the inner bore 886. A shoulder 887 may be configured to act as a stop to limit the potential extension of the rounded end 896 from the body 882. A biasing member, such as the illustrated compression spring 888, can be positioned within the first portion 886*a* of the inner bore 866 to bias the pin 890 in a fully extended position with respect to the body 882 as shown in FIG. 39. To assemble the first stop device 880, the rounded end 896 can be inserted through a first end 889 of the inner bore 886 and pushed into the bore until the enlarged end 892 of the pin 890 enters the bore 886. Next, the biasing member 888 can be pressed against the enlarged end 892 of the pin 890 to urge the enlarged end 892 against the shoulder 887 of the inner bore 886. Next, the end cap 898 may be pressed against the opposite end of the biasing member 888 to place the biasing member 888 under compression. The end cap 898 can then be tightened with a tool to threadingly attach the end cap 898 to the threaded portion 886*c* of the inner bore 886 and to provide an appropriate amount of precompression for the biasing member 888.

An example of assembling the tool 800 will now be described with respect to FIGS. 28-41. It will be appreciated that the steps of assembling may be carried out in a different order than the assembly method described herein. In one example, first end portions of the alignment pins 814*a*, 814*b* are press fit into corresponding bores 807*a*, 807*b* of the handle 802. The shank 808 of the handle 802 is then inserted through the central bore 862 of the locking member 860 with the second end portions of the alignment pins 814*a*, 814*b* being press fit into the corresponding bores 864*a*, 864*b* of the locking member 860 to fixedly attach the handle 802 to the locking member 860. The handle 802 and the locking member 860 are pressed together such that the shoulder 806 of the handle 802 engages the first side 860*a* of the locking member 860. The connection of the locking member 860 to the handle 802 with the alignment pins 814*a*, 814*b* rotationally couples the handle 802 and the locking member 860 together. Thus, a rotation of the handle 802 will necessarily result in a corresponding rotation of the locking member 860 in use. Although not shown, in another example, the handle 802 may be rotatably coupled to the first member 820 such that rotation of the handle 802 necessarily results in a corresponding rotation of the first member 820 while the locking member 860 may be rotated independent of the handle 802 and first member 820. It is still further contemplated that the locking member 860 may include portions configured to be directly gripped, with or without the illustrated handle, for rotation of the locking member 860 with respect to the first member 820.

Next, the carrying pins 840 may be installed on the first member 820 by inserting a distal end 847 of each carrying pin 840 through a corresponding aperture 826*a* from the first side 820*a* of the first member 820. Next, the carrying pins 840 are pushed through such that the distal end 847 and the carrying portion 846 of each carrying pin 840 extend from the second side 820*b* of the first member 820. Next, a tool is engaged with the tool recess 843 and worked such that the threaded portion 844 of each carrying pin 840 is threaded into the corresponding aperture 826*a* and the head 842 of each carrying pin 840 is received in the corresponding counter bore 826*b*. The magnets 825 can then be mounted in corresponding recesses 824 in the second side 820*b* of the first member 820.

Next, the shank 808 of the handle 802 may be inserted through the aperture 830 from the first side 820*a* of the first member 820. The screw 838 may then be inserted through the counter bore 836 of the washer 834 and threaded into the bore 810 of the shank 808. The screw 838 is then tightened until the shank edge 812 tightly engages a surface of the washer 834. At this point, the first member 820 is free to infinitely rotate about the shank 808 of the handle 802 and is free to translate a limited extent along the shank 808 between a first position where the first member 820 engages the locking member 860 and a second position where the first member 820 engages the washer 834.

Next, one or more stop devices may be provided to space the first member 820 from the locking member 860 and to limit rotation of the first member 820 about the shank 808 of the handle 802. In the illustrated example, a first stop device 880 and a second stop device 900 are provided to space the first member 820 from the locking member 860 and to limit rotation of the first member 820 about the shank 808 of the handle 802. In one example, the threaded portion 884 of the first stop device 880 is threadedly engaged with the first bore 828*a* of the first member 820 from the second side 820*b* of the first member 820. The first stop device 880 is then threaded into the first member 820 until the rounded end 896 is partially inserted into one of the apertures 868*a*, 868*b* in the first cavity 866. The first stop device 880 is further tightened such that the enlarged end 892 of the pin 890 travels away from the shoulder 887 against the compression force of the biasing member 888 while the rounded end 896 remains partially inserted in one of the apertures 868*a*, 868*b*. The first stop device 880 is further tightened until the washer 834 is lightly seated within the counterbore 832 in the second side 820*b* of the first member 820 and an end surface 883 of the body 882 is lightly seated against a bottom planar surface portion of the first cavity 866.

To equalize the force and strengthen the structural integrity of the tool 800, a second stop device 900 may also be provided. The second stop device can be substantially identical to the first stop device 880. In such an embodiment, the second cavity 874 can be provided with first and second apertures similar to the apertures 868*a*, 868*b* associated with the first cavity 866. Alternatively, as shown, the second cavity 874 can be substantially identical to the first cavity 866 without the apertures. In the illustrated example, the second stop device 900 can comprise a guide pin, threaded member or other design. In one example, the second stop device 900 can comprise a guide pin similar in design to the guide pin 744 illustrated in FIGS. 21 and 22. The guide pin can be configured to be press fit into the second bore 828*b* of the first member 820 and adjusted such that an end surface of the guide pin is lightly seated against a bottom planar surface portion of the second cavity 874.

Once assembled, it will be noted that the locking member 860 may have a limited capability of rotating relative to the first member 820. For example, the locking member 860 may be configured to rotate relative to the first member 820 by only about 150 although other pivot ranges may be provided in further examples. In the illustrated example, a side surface portion 885 of the body 882 of the first stop device is received in the first cavity 866. The side surface portion 885 is configured to engage the sides of the first cavity 866 to provide a rotational stop to limit the rotational range between the locking member 860 and the first member 820. Moreover, the rounded end 896 is partially received within one of the apertures 868*a*, 868*b* to provide two distinct rotational orientations between the locking member 860 and the first member 820. In a similar manner, a side surface portion of the second stop device 900 is configured to interact with sides of the second cavity 874 to provide a rotational stop to similarly limit the rotational range between the locking member 860 and the first member 820.

Methods of crimping with the example crimping machine 500 and the example crimping apparatus 700 and crimping tool 800 will now be described. Unless otherwise illustrated or discussed herein, steps of using the crimping apparatus 700 and crimping tool 800 can be similar or identical to the steps of using the crimping apparatus 100 and crimping tool 200 discussed above and in view of the drawings. In one example, the crimping apparatus 700 can be mounted to the crimping machine 500 in a similar manner as the crimping apparatus 100 is mounted to the crimping machine as discussed above and illustrated in FIG. 10. Next, the first member 820 is rotated relative to the locking member 860 such that the rounded end 896 of the pin 890 is partially received in the aperture 868*a*. In this position, the alignment axis 871 of the locking member 860 is parallel to the alignment axis 823 of the first member 820 wherein the first and second slots 870*a*, 870*b* of the locking member 860 are aligned with corresponding first and second slots 822*a*, 822*b* of the first member 820.

Example methods of the present invention can include the step of selecting a crimping member set 180 from a plurality of alternative crimping member sets. The crimping member set 180 can be selected to accommodate a particular crimping arrangement. Once selected, the tool 800 is engaged with the crimping member set 180 to carry the crimping members 182 and help install the crimping members to the retainers 742. For example, in a manner similar to that shown in FIG. 11, the crimping member set 180 and crimping tool 800 can be aligned with the axis of the crimping apparatus 700. The crimping member set 180 can then be inserted in a direction (e.g., see direction 101*a* in FIG. 11) along the axis of the crimping apparatus 700 until the crimping member set 180 is received within the interior area of the crimping apparatus 700.

In a manner similar to that shown in FIG. 12, once appropriately inserted, the first member 820 of the tool 800 abuts the front surface of the front member 712 to provide appropriate axial alignment between the crimping member set 180 and the retainers 742 of the crimping apparatus 700. Moreover, the alignment protrusions 760*a*, 760*b* extending from the front surface of the front member 712 can be at least partially received in the corresponding slots 822*a*, 822*b* of the first member 820 appropriate rotational alignment between the crimping member set 180 and the retainers 742. Moreover, it is noted that the alignment protrusions 760*a*, 760*b* can also be at least partially received through the corresponding slots 870*a*, 870*b* of the locking member 860. For example, during insertion, the locking head 766 of each alignment protrusion is configured to extend through each corresponding slot 822*a*, 822*b* of the first member 820 and through each corresponding slot 870*a*, 870*b* in the locking member 860. Once inserted, the alignment portion 764 of each alignment protrusion 760*a*, 760*b* is positioned within the corresponding slot 822*a*, 822*b* of the first member 820 to provide appropriate rotational alignment between the crimping member set 180 and the retainers 742. Thus, in a manner similar to that shown in FIG. 12A, once the crimping member set 180 is rotationally and axially aligned with respect to the retainers 742, the protrusion 190 of each crimping member 182 is aligned with the corresponding aperture of the engagement structure of each retainer 742.

After achieving axial and rotational alignment between the crimping member set 180 and the retainers 142, the tool 800 and associated crimping member set 180 may be locked in position with respect to the crimping apparatus 700 by rotating the handle 802, for example by about 15° in a clockwise direction (i.e., see direction 805 in FIG. 28) with respect to the first member 820. It will be appreciated, with reference to FIG. 31, that the first and second slots 870*a*, 870*b* were each located behind a locking shoulder portion 770 of the locking head 766 in the unlocked position. By rotating the handle 802 in the clockwise direction 805, the locking member 860 also rotates clockwise along direction 805 (see FIG. 31), wherein corresponding locking surfaces 873*a*, 873*b* are located behind the shoulder 770 of the locking head 766 of each protrusion to selectively lock the tool 800 together with the aligned crimping member set 180 to the crimping apparatus 700. Once locked, the rounded end 896 of the pin 890 of the first stop device 880 is partially received in the aperture 868*b* to help prevent inadvertent rotation of the locking member and handle to the unlocked orientation until desired.

After achieving axial and rotational alignment between the crimping member set 180 and the retainers 742, and after the tool 800 and the crimping member set 180 are locked to the crimping apparatus as discussed above, the crimping machine 500 is activated to cycle the machine in a manner similar to the FIGS. 13 and 13A above. However, as the tool 800 is locked in position with respect to the crimping apparatus 700, the operator need not hold the handle 802 during the cycling procedure, thereby increasing the overall safety of the device in certain applications.

After cycling the machine 500, the crimping member 182 is removably connected to the corresponding retainer 742 by the engagement structure of the corresponding retainer 742. The handle 802 can then be rotated in the counterclockwise direction such that the locking member 860 achieves an unlocked orientation with the first and second slot 870*a*, 870*b* positioned behind the shoulders 770 of the locking heads 766. The tool 800 can then be removed from the crimping apparatus 700 while the crimping member set 180 remains connected to the retainers 742. The machine 500 can then be cycled to expand the crimping member set to perform a subsequent crimping procedure.

In order to remove the crimping member set 180 after performing the crimping procedure, the machine 500 may be cycled to contract the crimping member set. Then the carrying portions 846 of the carrying pins 840 may be inserted into the corresponding carrying bores 184 in the crimping members 182. The handle 802 can then be rotated clockwise to lock the tool 800 and crimping member set 180 to the crimping apparatus 700. Next, the machine 500 may be cycled back such that the retainers 742 expand while the crimping members 182 remain attached to the carrying pins 840. As the tool 800 is locked with respect to the crimping apparatus 700, there is no need for one to hold the handle during the cycling procedure, thereby increasing the overall safety of the device in certain applications. Once the crimping members 182 are disconnected from the retainers 742, the handle 802 may be rotated counterclockwise to unlock the tool 800 with respect to the crimping apparatus 700. The magnets 825 help encourage the crimping members 182 to remain on the carrying pins 840 as the tool 800 is used to remove the crimping member set 180 from the crimping apparatus 700.

While the tool 800 is described for use with the crimping apparatus 700, the crimping tool 800 can also be used with other crimping apparatus. For example, the tool 800 can be used with a crimping apparatus similar to the crimping apparatus 100 discussed above wherein the alignment protrusions 113*a*, 113*b* have been replaced with the alignment protrusions 760*a*, 760*b*.

The concepts of the present invention may be used with different types of crimping machines. For example, as described above, crimping machines may be employed with a press plate configured to move the crimping apparatus to engage a stationary cam ring. In another example, a crimping machine may be used wherein the crimping apparatus remains stationary and the cam ring is moved to engage the stationary crimping apparatus to perform the crimping procedure. In another example, crimping machines may be designed to simultaneously move the crimping apparatus and the cam ring to perform the crimping function.

From the above description of the invention, those skilled in the art will perceive improvements, changes and modifications. Such improvements, changes and modifications within the skill of the art are intended to be covered by the invention herein. While the invention may incorporate a wide variety of aspects, example aspects may include one or more of the following and further aspects discussed above.

What is claimed is:

1. A crimping apparatus comprising:

a support structure including an alignment element;

a plurality of retainers movably attached to the support structure and radially arranged about an axis of the crimping apparatus, each retainer including an engagement structure;

a plurality of crimping members including an engagement element, wherein each engagement element is configured to interact with the engagement structure of a respective one of the plurality of retainers to removably connect each of the crimping members to a respective one of the plurality of retainers; and a tool configured to simultaneously support the plurality of crimping members, the tool including a one-piece alignment member, wherein the one-piece alignment member includes an alignment structure configured to interact with the alignment element of the support structure to provide substantial radial alignment between the engagement element of each of the crimping members and the corresponding engagement structure of the respective retainers, wherein the one-piece alignment member further includes a plurality of carrying pins directly connected to the one-piece alignment member, wherein each of the carrying pins extend from the one-piece alignment member to support a corresponding one of the plurality of crimping members.

2. The crimping apparatus of claim 1, wherein the engagement structure of each retainer comprises an aperture.

3. The crimping apparatus of claim 2, wherein the engagement element of each crimping member comprises a protrusion configured to be inserted into the aperture of a corresponding one of the plurality of retainers.

4. The crimping apparatus of claim 3, wherein the engagement structure of each retainer further comprises a latch configured to removably engage the protrusion of the corresponding crimping member.

5. The crimping apparatus of claim 1, wherein the alignment element of the support structure comprises at least one protrusion and the alignment structure of the tool comprises at least one opening configured to receive the protrusion.

6. The crimping apparatus of claim 5, further comprising a locking member configured to selectively engage the protrusion of the support structure to selectively inhibit relative axial movement between the tool and the support structure along the axis of the crimping apparatus.

7. The crimping apparatus of claim 1, further comprising a locking member configured to selectively lock the tool with respect to the support structure while the engagement element of each of the crimping members is substantially aligned with the corresponding engagement structure of the respective retainers.

8. A tool for supporting a plurality of crimping members with respect to a support structure comprising:

a support member including a plurality of carrying pins extending from the support member, wherein each of the carrying pins is configured to support a corresponding one of a plurality of crimping members; and a locking member rotatably mounted with respect to the support member, wherein the locking member includes a locking surface configured to selectively engage the support structure to selectively lock the position of the support member with respect to the support structure, wherein the support member includes at least one opening configured to facilitate rotational alignment between the support member and the support structure, and wherein the locking member includes at least one opening, wherein the locking member is configured to be rotated relative to the support member between an unlocked position wherein the opening of the locking member is substantially aligned with the opening of the support member and a locked position wherein the opening of the locking member is substantially misaligned with the opening of the support member.

9. The tool of claim 8, further comprising at least one stop device configured to limit rotation between the locking member and the support member.

10. The tool of claim 8, wherein the locking member and the support member are each substantially circular and concentrically mounted with respect to one another.

11. The tool of claim 8, further comprising a handle fixedly attached to the locking member, wherein the support member is rotatably attached to the handle.

12. A crimping apparatus comprising:

a support structure including at least one protrusion;

a plurality of retainers movably attached to the support structure and radially arranged about an axis of the crimping apparatus, each retainer including an engagement structure;

a plurality of crimping members including an axial bore and an engagement element, wherein each engagement element is configured to interact with the engagement structure of a respective one of the plurality of retainers to removably connect each of the crimping members to a respective one of the plurality of retainers; and a tool including a support member with a plurality of carrying pins, wherein each carrying pin is configured to be inserted into the axial bore of a respective one of the plurality of crimping members to allow the tool to simultaneously support the plurality of crimping members, the support member further including at least one opening configured to interact with the protrusion of the support structure to provide substantial radial alignment between the engagement element of each of the crimping members and the corresponding engagement structure of the respective retainers, and a locking member configured to selectively engage the protrusion of the support structure to selectively inhibit relative axial movement between the tool and the support structure along the axis of the crimping apparatus.

13. The crimping apparatus of claim 12, wherein the locking member is configured to selectively rotate with respect to the support member between a locked position to inhibit relative axial movement between the tool and the support structure along the axis of the crimping apparatus and an unlocked position to permit relative axial movement between the tool and the support structure along the axis of the crimping apparatus.

14. The crimping apparatus of claim 13, wherein the locking member includes at least one opening, wherein the opening of the locking member is substantially aligned with the opening of the support member when the locking member is oriented in the unlocked position and the opening of the locking member is substantially misaligned with the opening of the support member when the locking member is oriented in the locked position.

* * * * *